US008191999B2

(12) United States Patent
Umeda

(10) Patent No.: US 8,191,999 B2
(45) Date of Patent: Jun. 5, 2012

(54) INKJET PRINTER

(75) Inventor: Takaichiro Umeda, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 1194 days.

(21) Appl. No.: 12/005,812

(22) Filed: Dec. 27, 2007

(65) Prior Publication Data

US 2008/0165229 A1 Jul. 10, 2008

(30) Foreign Application Priority Data

Dec. 27, 2006 (JP) ..... 2006-352649

(51) Int. Cl.
*B41J 2/175* (2006.01)

(52) U.S. Cl. ..... 347/85; 347/86

(58) Field of Classification Search ..... 347/85, 347/86

See application file for complete search history.

(56) References Cited

U.S. PATENT DOCUMENTS

| | | | | |
|---|---|---|---|---|
| 6,966,641 | B2 * | 11/2005 | Taniguchi et al. | 347/86 |
| 2002/0012030 | A1 | 1/2002 | Okamoto et al. | |
| 2006/0132554 | A1 * | 6/2006 | Ota et al. | 347/85 |
| 2006/0192821 | A1 | 8/2006 | Koga et al. | |
| 2006/0203047 | A1 * | 9/2006 | Koga et al. | 347/85 |
| 2007/0008395 | A1 * | 1/2007 | Masubuchi et al. | 347/104 |

FOREIGN PATENT DOCUMENTS

| | | |
|---|---|---|
| JP | 55-5220 | 1/1980 |
| JP | 2001-301197 | 10/2001 |
| JP | 2004181952 | 7/2004 |
| JP | 2004358918 | 12/2004 |
| JP | 2006-168341 | 6/2006 |
| JP | 2006224531 | 8/2006 |
| JP | 2006-231851 | 9/2006 |
| JP | 2007-130977 | 5/2007 |

* cited by examiner

*Primary Examiner* — Matthew Luu
*Assistant Examiner* — Jannelle M Lebron
(74) *Attorney, Agent, or Firm* — Frommer Lawrence & Haug LLP

(57) ABSTRACT

In an inkjet printer of a station-supply type, when ink is supplied from a main tank of an ink cartridge to a sub tank storing ink to be supplied to a recording head, the ink cartridge and the sub tank are connected to each other. The inkjet printer includes: a piston pump including (a) a cylinder which communicates with the main tank and (b) a piston which is slidable in the cylinder in a lengthwise direction thereof and cooperates with the cylinder to form a pressure chamber; a power transmission device which transmits a power to the piston in a state in which the ink cartridge is attached to a frame of the inkjet printer; and a piston-position initializing device which moves the piston to a predetermined initial position.

14 Claims, 17 Drawing Sheets

INKJET PRINTER

CROSS REFERENCE TO RELATED APPLICATION

The present application claims priority from Japanese Patent Application No. 2006-352649, which was filed on Dec. 27, 2006, the disclosure of which is herein incorporated by reference in its entirety.

BACKGROUND OF THE INVENTION

1. Field of the Invention

The present invention relates to an inkjet printer.

2. Discussion of Related Art

An inkjet printer is a sort of image recording apparatus which records an image on a recording sheet as a recording medium by ejecting droplets of ink from a recording head. Thus, ink is needed to be supplied to the recording head.

For example, Patent Document 1 (JP-A-2004-181952) discloses an inkjet printer of a station-supply type in which a sub tank is provided in a carriage carrying a recording head, and an ink cartridge and the sub tank are connected to each other when ink is supplied to the sub tank, and disconnected from each other when ink is not supplied to the sub tank.

Also, Patent Document 2 (JP-A-2004-358918) discloses an inkjet printer including: (1) a sub tank which has a bellows disposed at a position apart from a recording head; (2) a main tank which stores ink in the form of an ink package; (3) a pipe such as a tube which connects the sub tank and the main tank to each other; and (4) an ink supply valve provided in the tube. The ink supply valve is opened or closed so as to control supplying ink from the main tank to the recording head via the sub tank.

For manufacturing an inkjet printer of a station-supply type, the present inventor has experimentally produced and examined a new inkjet printer as a first example different from the respective inkjet printers disclosed in Patent Document 1 and Patent Document 2. The new inkjet printer will be described below.

The new inkjet printer includes a sub tank constituted by an elastically deformable container like a bellows. In the inkjet printer, when ink is supplied to the sub tank, the sub tank is once compressed so that a volume thereof is decreased, and then the volume thereof is expanded and increased to an original state (i.e., a normal state) by an elastic force (i.e., a restoring force) of the sub tank. As a result, ink stored in the ink cartridge is sucked to the sub tank.

A recording head of the inkjet printer ejects a droplet of ink through a nozzle by a pressing means utilizing a deformation of a piezoelectric element or a change in volume of bubbles by a heating resistance element. Normally, a shut-off valve is not provided in the nozzle, and in a waiting state in which ink is not ejected, a meniscus is formed in the nozzle such that a surface of ink is curved inward, with the result that the ink is prevented from leaking out of the nozzle.

Therefore, when the sub tank is expanded in a state in which the meniscus formed in the nozzle is broken, air flows into the sub tank through the nozzle, causing the possibility that an adequate volume of ink cannot be supplied to the sub tank.

Accordingly, the present inventor has experimentally produced and examined another new inkjet printer as a second example which includes a piston pump provided in an ink cartridge for supplying ink stored in the ink cartridge to a sub tank and which operates the piston pump when ink is supplied to the sub tank.

In the second new inkjet printer, since the piston pump is disposed independently of the sub tank, no air flows into the sub tank through a nozzle when ink is supplied to the sub tank. As a result, an adequate volume of ink can be supplied to the sub tank. However, another problem has occurred as mentioned below.

In the second new inkjet printer, the piston pump includes: (a) a cylinder which communicates with a main tank storing ink; (b) a piston which is slidable in the cylinder in a lengthwise direction thereof and cooperates with the cylinder to form a pressure chamber; and (c) a piston rod which is movable integrally with the piston and receives a power to move the piston from a main body side of the inkjet printer and operates the piston to move.

However, in a case in which a new ink cartridge is attached to a frame of the inkjet printer or the piston pump is repeatedly started and stopped, a problem occurs as follows: An actual stop position of the piston when the piston pump is stopped is not aligned with a predetermined initial position (i.e., a zero-point position), so that a volume of ink supplied to the sub tank is changed.

Especially in a full-color inkjet printer including a plurality of ink cartridges, a plurality of piston pumps are needed corresponding to a plurality of inks having respective colors. In a case in which respective actual stop positions of respective pistons of the plurality of piston pumps are not aligned with respective predetermined initial positions and are different from each other, respective volumes of inks supplied to respective sub tanks are changed.

SUMMARY OF THE INVENTION

It is therefore an object of the present invention to provide an inkjet printer of a station-supply type in which, when ink is supplied from a main tank of an ink cartridge to a sub tank storing ink to be supplied to a recording head, the ink cartridge and the sub tank are connected to each other, the inkjet printer including a piston pump, and assuring that an actual stop position of a piston is prevented from being misaligned with a predetermined initial position.

According to the present invention, there is provided an inkjet printer of a station-supply type in which, when ink is supplied from a main tank of an ink cartridge to a sub tank storing ink to be supplied to a recording head, the ink cartridge and the sub tank are connected to each other, the inkjet printer comprising: a piston pump including (a) a cylinder which communicates with the main tank and (b) a piston which is slidable in the cylinder in a lengthwise direction thereof and cooperates with the cylinder to form a pressure chamber; a power transmission device which transmits a power to the piston in a state in which the ink cartridge is attached to a frame of the inkjet printer; and a piston-position initializing device which moves the piston to a predetermined initial position.

In the present inkjet printer, the actual stop position of the piston is prevented from being misaligned with the predetermined initial position. Thus, the present inkjet printer can solve the problem in which the volume of ink supplied to the sub tank is changed. Also, in a full-color inkjet printer including a plurality of ink cartridges corresponding to a plurality of inks having respective colors, respective volumes of inks supplied to respective sub tanks are prevented from being differed from each other. The piston pump may be provided in the ink cartridge or in the frame of the inkjet printer.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Hereinafter, there will be described preferred embodiments of the present invention with reference to the drawings. A printer engine portion 1 of an inkjet printer as a first embodiment to which the present invention is applied is a well-known image recording apparatus which records an image on a recording medium by ejecting droplets of ink toward the recording medium while conveying the recording medium. Though the recording medium may be a piece of paper, a piece of cloth, a film made of a synthetic resin or a disc for an optical recording, hereinafter, the recording medium will be referred to as "a recording sheet" for a convenience of explanation.

Figure 1:
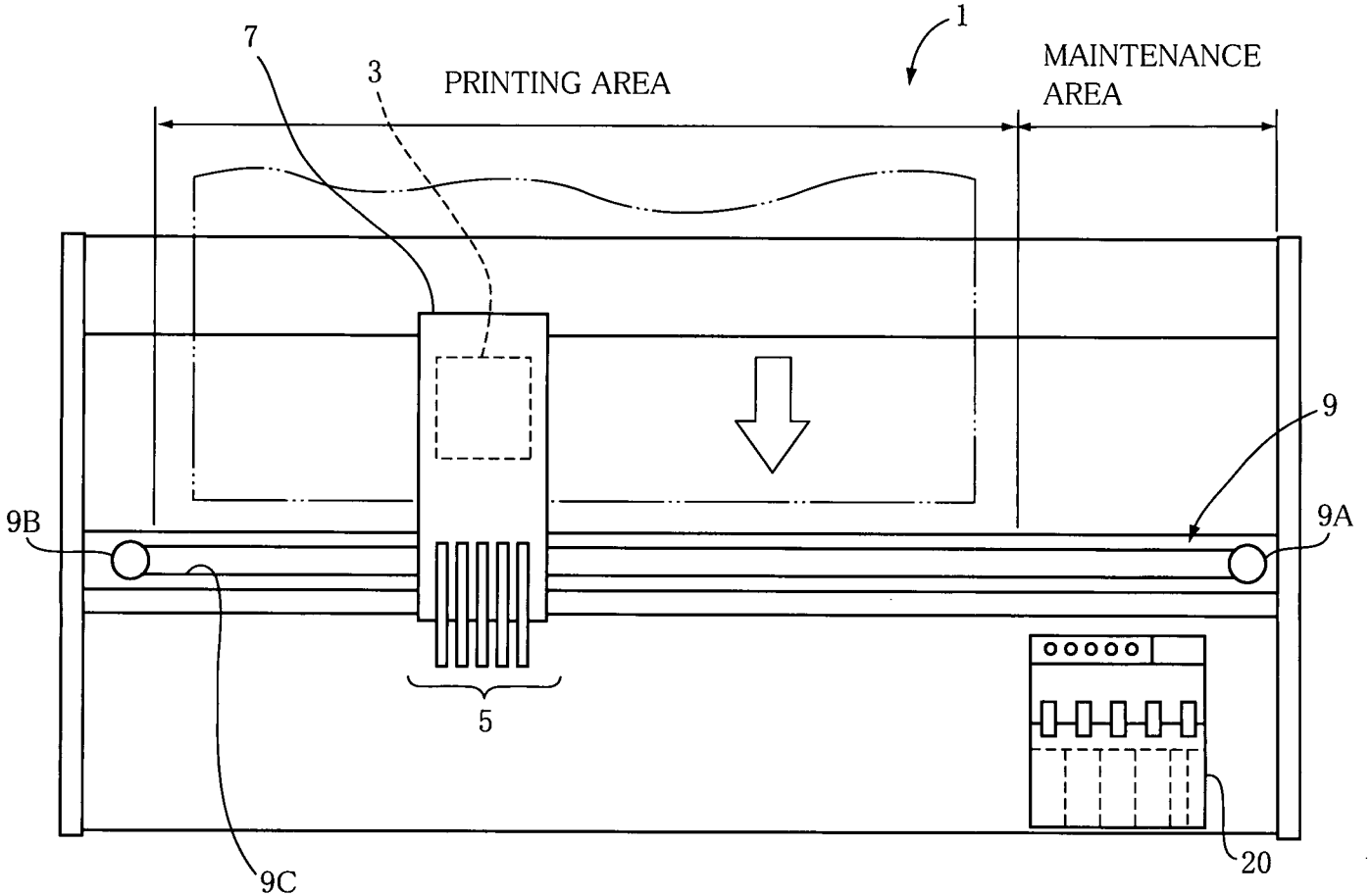
FIG. 1 is a schematic view showing a basic portion (a printer engine portion) of an inkjet printer as a first embodiment to which the present invention is applied.

As shown in FIG. 1, the printer engine portion 1 includes: a recording head 3 which ejects ink toward the recording sheet; a carriage 7 which carries the recording head 3 and a plurality of sub tanks 5 storing the ink to be ejected by the recording head 3; a scanning device 9 which reciprocates the carriage 7 in a main scanning direction (i.e., in a left-right direction in FIG. 1); and a main tank unit 20 to which a plurality of ink cartridges 10 (shown in FIG. 2) storing the ink to be supplied to the sub tanks 5 are attached.

The recording head 3 ejects the ink stored in the sub tanks 5 by a pressing means that causes a deformation of a piezoelectric element or a heating resistance element that causes a change in volume of bubbles. In the present embodiment, the recording head 3 ejects the ink by utilizing the deformation of the piezoelectric element.

The plurality of sub tanks 5 correspond to a plurality of inks that have respective colors and are ejected from the recording head 3. In the present embodiment, five sub tanks 5 are provided corresponding to five colors of inks such as cyan (C), magenta (M), yellow (Y), black (B), and photo black (PBk) inks, respectively.

The scanning device 9 includes: a driving pulley 9A which is disposed at one end of the printer engine portion 1 in the main scanning direction; a driven pulley 9B which is disposed at the other end of the same 1 in the main scanning direction; and an endless belt 9C which connects the two pulleys 9A, 9B. The carriage 7 is fixed to the endless belt 9C. When the driving pulley 9A is driven and the endless belt 9C is driven or circulated, the carriage 7 is reciprocated through the belt 9C in the main scanning direction.

When an image is recorded on the recording sheet, in a printing area (shown in FIG. 1), the carriage 7 (the recording head 3) reciprocates in the main scanning direction while the recording sheet is being conveyed in a sub scanning direction and the recording head 7 ejects ink toward the recording sheet so as to record the image on the recording sheet. On the other hand, when the image operation is not performed, or when maintenance operations such as supplying of ink to the sub tanks 5 are performed, the carriage 7 is moved to and positioned in a maintenance area (shown in FIG. 1).

The present inkjet printer is an inkjet printer of a station-supply type, in which the main tank unit 20 and the sub tanks 5 are connected to each other when ink is supplied from the main tank unit 20 to the sub tanks 5, and the main tank unit 20 and the sub tanks 5 are disconnected from each other when ink is not supplied to the sub tanks 5, e.g., when the image recording operation is performed.

More precisely, when a volume of ink stored in each sub tank 5 is lower than a predetermined volume of ink, a main-tank joint valve 30 (shown in FIG. 9) provided in the main tank unit 20 and a sub-tank joint valve 40 (shown in FIG. 9) provided in each sub tank 5 are connected to each other to supply ink to the sub tank 5. When the volume of ink stored in the sub tank 5 is larger than the predetermined volume of ink, the main-tank joint valve 30 and the sub-tank joint valve 40 remain disconnected from each other.

Figure 2:
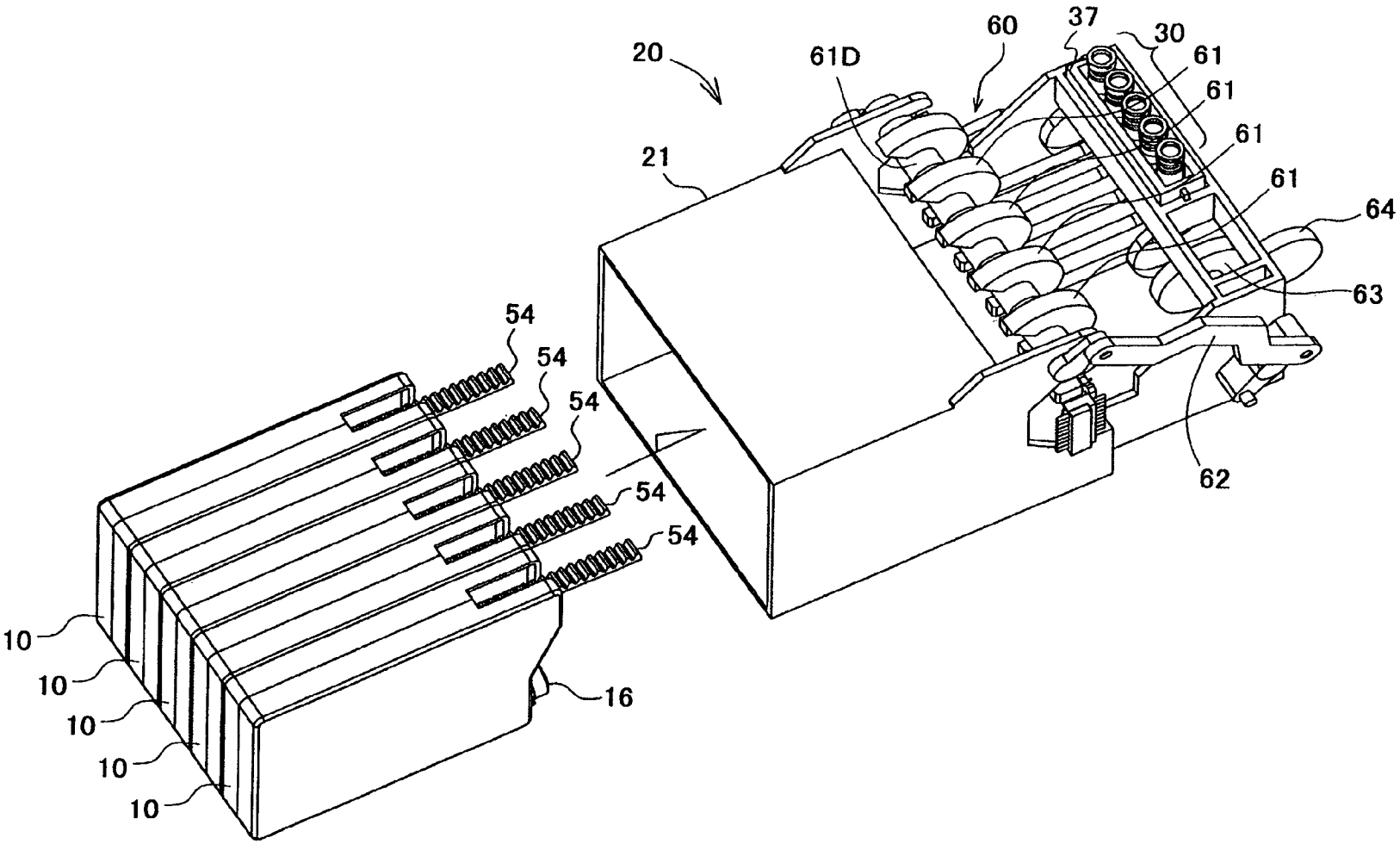
FIG. 2 is a perspective view of a main tank unit of the inkjet printer in a state in which a plurality of ink cartridges are removed therefrom.
Figure 3:
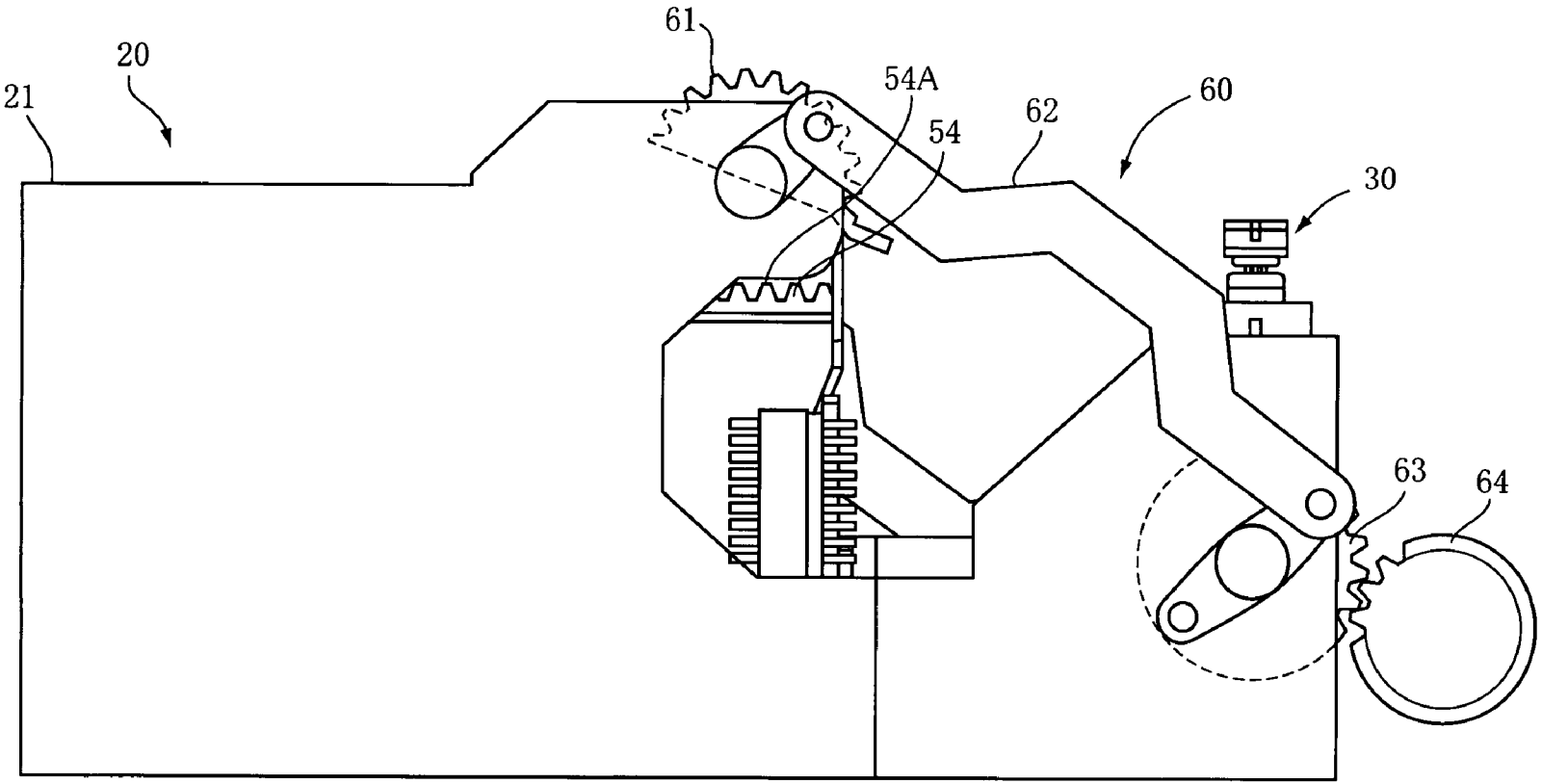
FIG. 3 is a side view of the main tank unit.

As shown in FIG. 2, the main tank unit 20 includes: a plurality of ink cartridges 10 which correspond to the plurality of inks and whose number is the same as that of the sub tanks 5; a parallelepiped cartridge casing 21 which accommodates the ink cartridges 10; a pump drive device 60 which drives a piston pump 50 (shown in FIG. 6) provided in each ink cartridge 10; and the main-tank joint valves 30.

Figure 6:
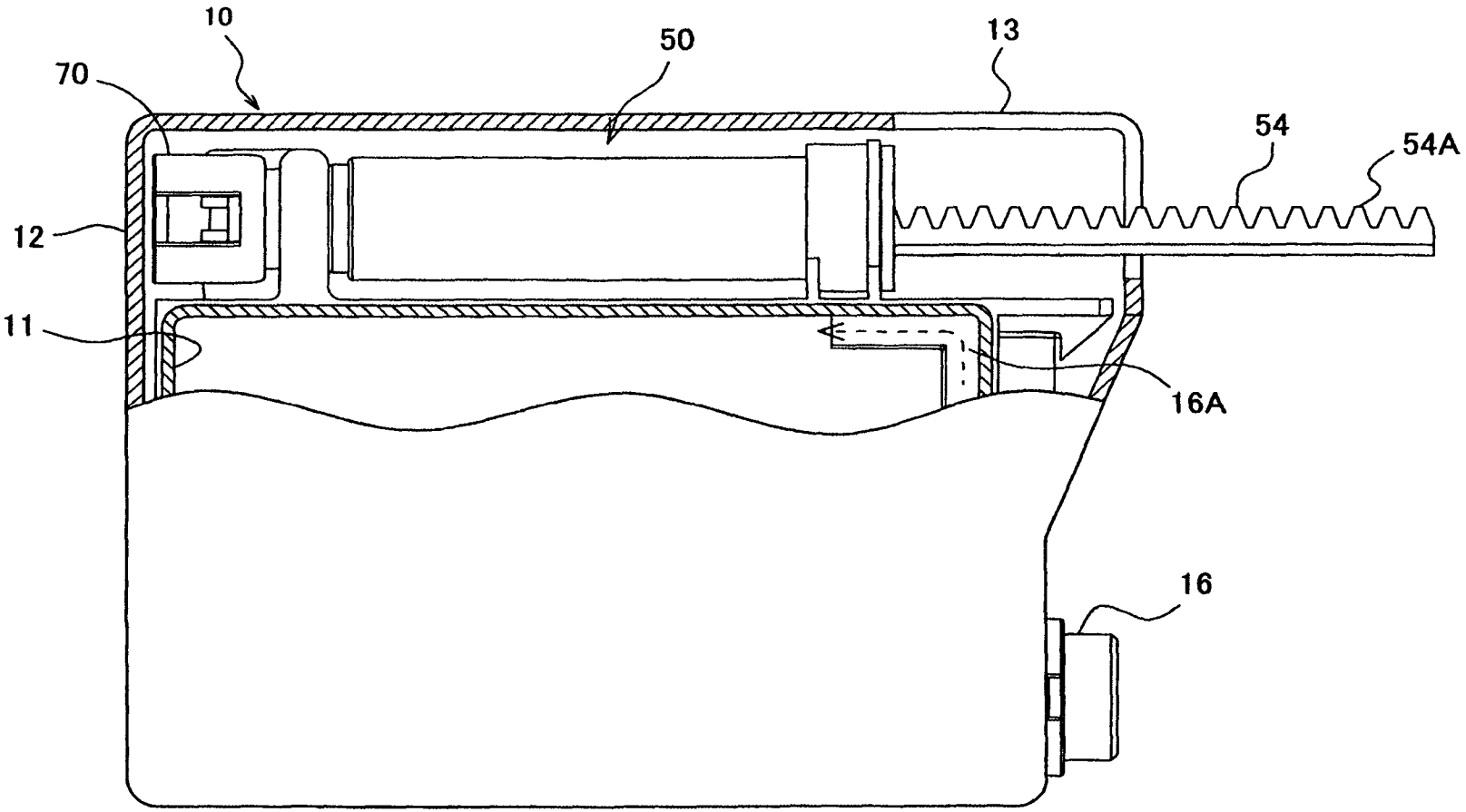
FIG. 6 is a partly cross-sectional side view of the ink cartridge.

As shown in FIG. 6, each of the ink cartridges 10 includes: an ink tank 11 as a main ink-storing tank; the piston pump 50 which operates to increase or decrease a pressure in the ink tank 11; and a casing 12 which accommodates the ink tank 11 and the piston pump 50.

Figure 8:
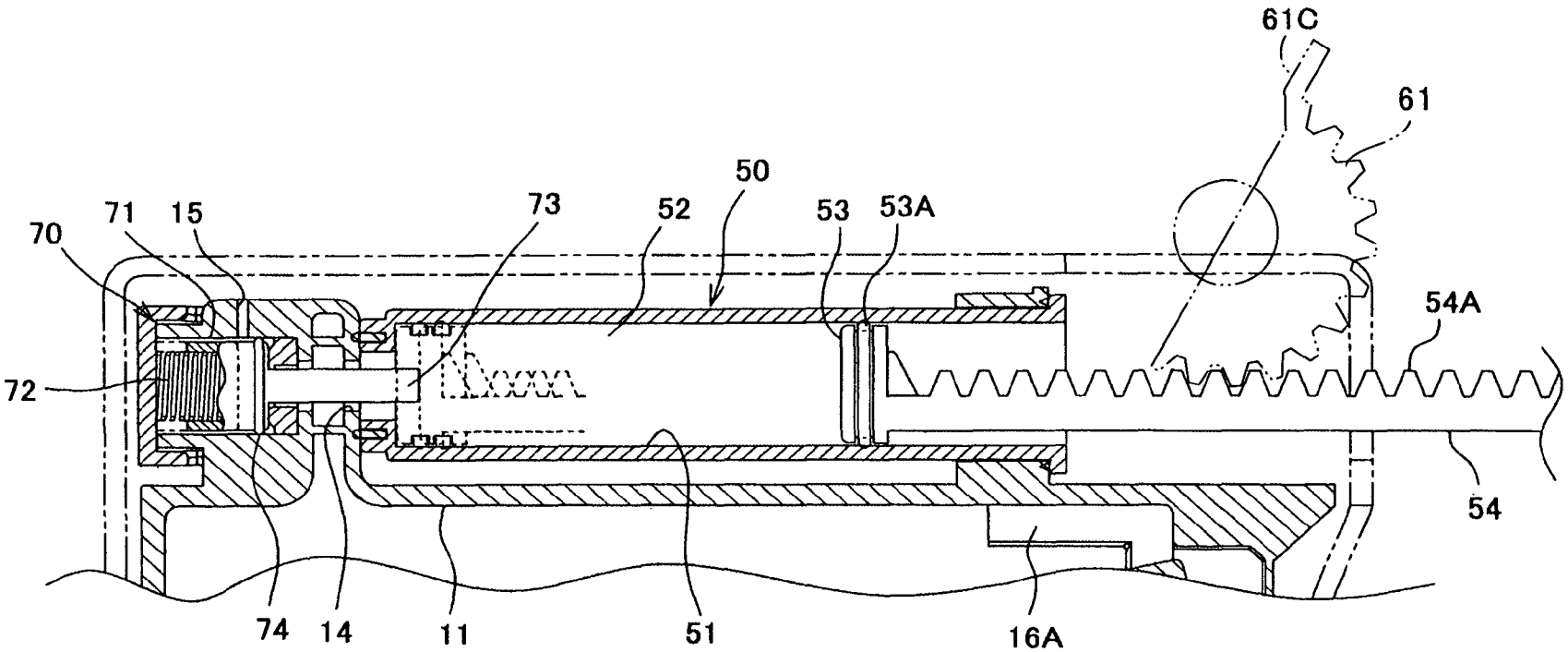
FIG. 8 is a cross-sectional view of an internal structure of a piston pump of the inkjet printer.

As shown in FIG. 8, the piston pump 50 includes: a cylinder 51 which communicates with the ink tank 11; a piston 53 which is slidable in the cylinder 51 in a lengthwise direction thereof and cooperates with the cylinder 51 to form a pressure chamber 52; and a piston rod 54 which is movable integrally with the piston 53 and receives a power to move the piston 53, from a main body of the inkjet printer, i.e., the pump drive device 60.

On an outer circumferential portion of the piston 53, an O-ring 53A as a sealing device is disposed. The O-ring 53A is slidably held in contact with an inner circumferential surface of the cylinder 51, so that the pressure chamber 52 is air-tightly (fluid-tightly) closed.

In the present embodiment, the piston 53 and the piston rod 54 are integrally formed of a synthetic resin. In one surface of the piston rod 54 opposite to the ink tank 11 (an upper surface of the piston rod 54 in FIG. 8), there is formed a rack 54A which is engageable with a pinion 61 of the pump drive device 60.

Figure 5A:
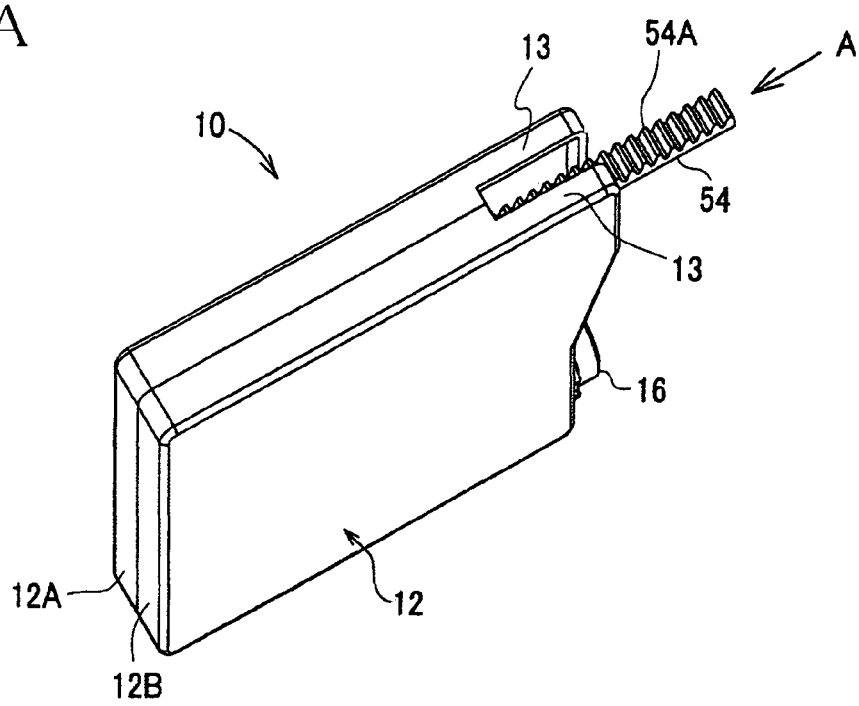
FIG. 5A is a perspective view of one of the ink cartridges.
Figure 5B:
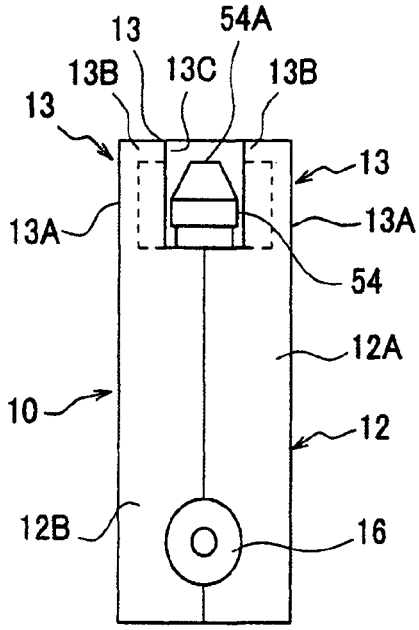
FIG. 5B is a view of the ink cartridge as seen in a direction indicated by an arrow A in FIG. 5A.
Figure 7:
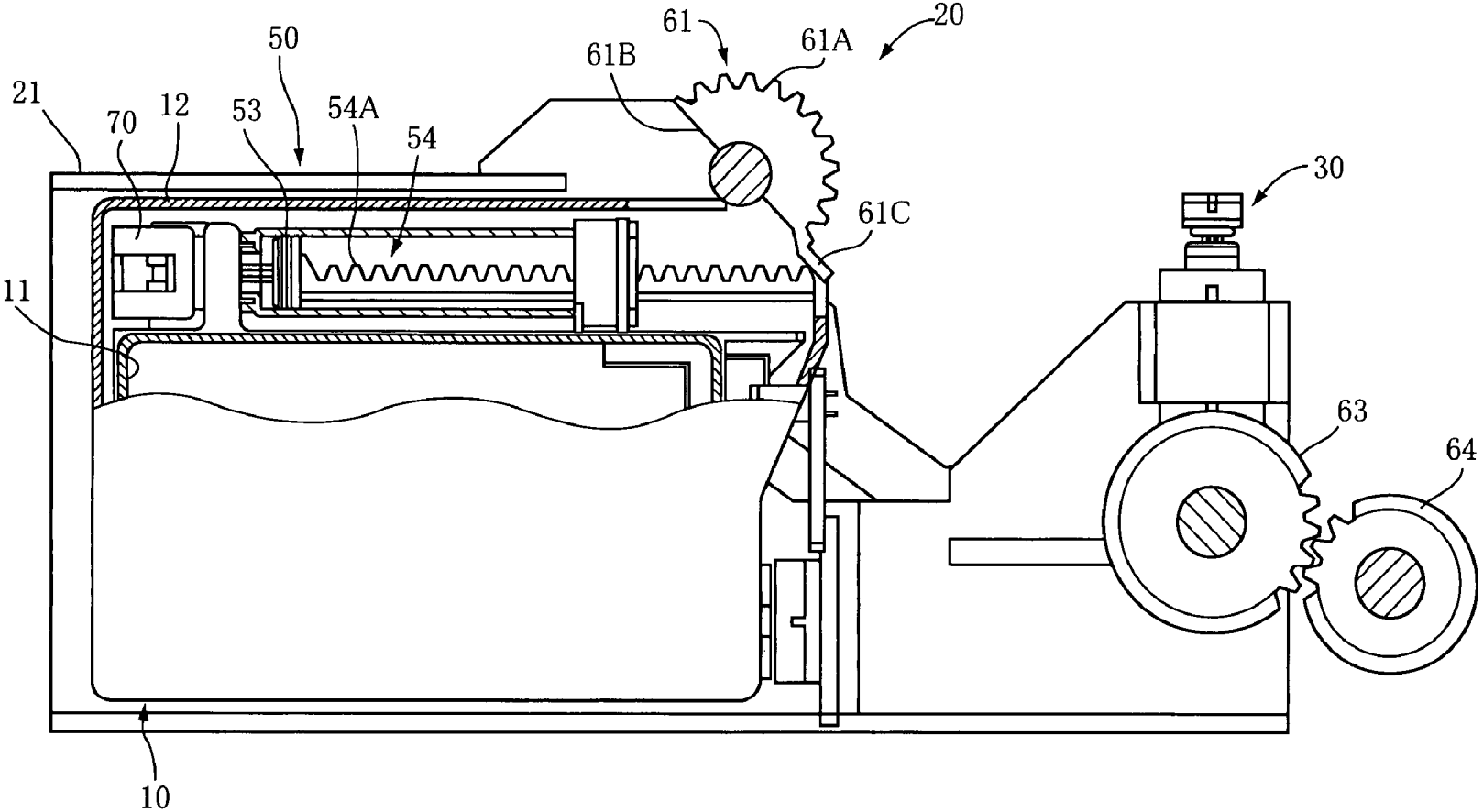
FIG. 7 is a partly cross-sectional side view of the main tank unit.

As shown in FIGS. 5A and 5B, at least a portion of the rack 54A engageable with the pinion 61 is covered and protected by a pair of rod covers 13. The pair of rod covers 13 cover a whole (i.e., a full range) of the piston rod 54 in a lengthwise direction thereof, at least when a volume of the pressure chamber 52 is most reduced, in other words, when the piston 53 is positioned at a left-hand side end of the cylinder 51 as seen in FIG. 7.

As shown in FIG. 5B, the pair of rod covers 13 are disposed on opposite sides with respect to the piston rod 54 in a widthwise direction perpendicular to the lengthwise direction of the piston rod 54, that is, the piston rod 54 is located between the pair of rod covers 13. Each of the rod covers 13 has an L-shaped structure in its cross section which has a side cover portion 13A covering a side portion of the piston rod 54 in the widthwise direction of the piston rod 54 (i.e., a left-hand or right-hand side portion of the piston rod 54 in FIG. 5B) and a rack cover portion 13B covering the rack 54A of the piston rod 54 (i.e., an upper side portion of the piston rod 54 in FIG. 5B). There is also provided a clearance 13C between the two rack cover portions 13B in the widthwise direction and the pinion 61 is insertable through the clearance 13C to engage the rack 54A.

In the present embodiment, as shown in FIG. 5A, the casing 12 includes a first casing 12A and a second casing 12B which are fixed to each other. The pair of rod covers 13 including the respective side cover portions 13A and the respective rack cover portions 13B are formed integrally with the first casing 12A and the second casing 12B, respectively.

As shown in FIG. 8, a passage 14 formed between the cylinder 51 (or the pressure chamber 52) and the ink tank 11 communicates with the atmosphere via an atmosphere communication passage 15. In another passage formed between the atmosphere communication passage 15 and the passage 14, an atmosphere communication valve 70 is provided, which selectively opens or closes the atmosphere communication passage 15 so as to switch between an open state in which the ink tank 11 communicates with the atmosphere and a closed state in which the ink tank 11 is shut off from the atmosphere.

The atmosphere communication valve 70 consists of: a valve element 71 which opens or closes the atmosphere communication passage 15; a spring 72 which applies an elastic force to the valve element 71 to press the valve element 71 in a direction in which the atmosphere communication passage 15 is closed; a push-rod portion 73 which extends to the pressure chamber 52 and is movable integrally with the valve element 71.

In the present embodiment, the atmosphere communication passage 15 opens toward an outer circumferential surface of the valve element 71, extending in a direction perpendicular to directions of movement of the valve element 71 (i.e., leftward and rightward directions in FIG. 8), that is, in a vertical direction. On the outer circumferential surface of the valve element 71, an O-ring 74 as a sealing device is disposed to be slidably contacted with an inner circumferential surface of a wall of the atmosphere communication valve 70 in which the atmosphere communication passage 15 is formed and to air-tightly (i.e., fluid-tightly) close a clearance between the inner circumferential surface and the outer circumferential surface.

When the piston 53 is moved in the leftward direction in FIG. 8 so as to decrease the volume of the pressure chamber 52, the valve element 71 of the atmosphere communication valve 70 is pressed by the piston 53 via the push-rod portion 73 and moved (or slid) in the leftward direction from a position shown in FIG. 8, so that the atmosphere communication passage 15 is opened. On the other hand, when the piston 53 is moved in the rightward direction in FIG. 8 so as to increase the volume of the pressure chamber 52, the valve element 71 is slid in the rightward direction by the elastic force of the spring 72 and to be positioned at a retracted position shown in FIG. 8, with the result that the atmosphere communication passage 15 is closed.

As shown in FIG. 6, the ink tank 11 is located below the piston pump 50. In a lower end portion of the ink tank 11, an ink-supply opening 16 is disposed to be connected to the main-tank joint valve 30.

Figure 12:
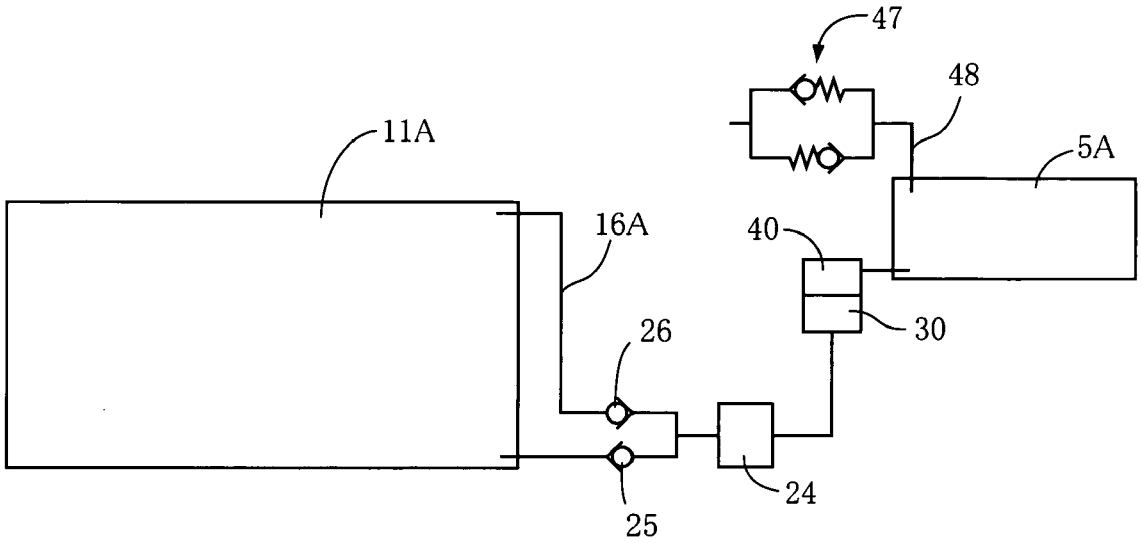
FIG. 12 is a schematic view showing an ink-supply circuit of the inkjet printer.

As shown in FIG. 12, in the vicinity of the ink-supply opening 16 of the ink tank 11, there are provided the following elements: a shut-off valve 24 which opens or closes the ink-supply opening 16; a first check valve 25 which permits a flow of ink from an ink-tank chamber 11A of the ink tank 11 to the ink-supply opening 16; and a second check valve 26 which permits the flow of ink from the sub tank 5 to the ink-supply opening 16. In the present embodiment, the ink returned from the sub tank 5 flows into the ink-tank chamber 11A through an upper portion of the ink-tank chamber 11A via a return passage 16A.

The pump drive device 60 is for transmitting a power to the piston rod 54 to move the piston 53 in the lengthwise direction of the piston rod 54. The pump drive device 60 includes the pinions 61, a connecting rod 62, a first transmission gear 63 and a second transmission gear 64.

The second transmission gear 64 is driven and rotated by an LF (Line Feed) motor 65 (shown in FIG. 16) also functioning as a drive source for feeding the recording sheet. A drive force of the LF motor 65 is transmitted to the second transmission gear 64 and then transmitted to the pinions 61 through the first transmission gear 63, the connecting rod 62 and a rotation shaft 61*d* having an arm. The connecting rod 62 connects the first transmission gear 63 and the arm of the rotation shaft 61*d*.

The drive force of the LF motor 65 is switched by a operation switch solenoid 66 (shown in FIG. 16) between states in which the drive force of the LF motor 65 is transmitted to a sheet-feed roller (not shown), and transmitted to the first transmission gear 63 (via the second transmission gear 64).

As shown in FIG. 7, each pinion 61 includes, on an outer circumference thereof, a first area 61A which has a toothed portion engageable with the rack 54A and a second area 61B free of the toothed portion. In the second area 61B, a projected rod-moving portion 61C is provided and is operable to contact one (a right-hand one in FIG. 7) of opposite ends of the piston rod 54 in the lengthwise direction thereof and move the same 54 to a predetermined initial position when an initializing operation is performed as described later.

When the initializing operation is performed, the second area 61B is opposed to the rack 54A, that is, the pinion 61 is not engaged with the rack 54A, and the pinion 61 is rotated in a state in which the rod-moving portion 61C is held in contact with the one end of the piston rod 54, so that the piston rod 54 is moved in a direction in which the volume of the pressure chamber 52 is decreased.

As shown in FIG. 2, the plurality of pinions 61 are provided corresponding to the respective ink cartridges 10. The plurality of pinions 61 are fixed to the rotation shaft 61D and are rotatable integrally with each other. In other words, the plurality of pinions 61 are mechanically synchronized and rotatable with each other by the same rotation amount (the same rotation angle).

An ink supply device of a station-supply type is a device for supplying inks from the main tank unit 20 to the respective sub tanks 5.

Figure 9:
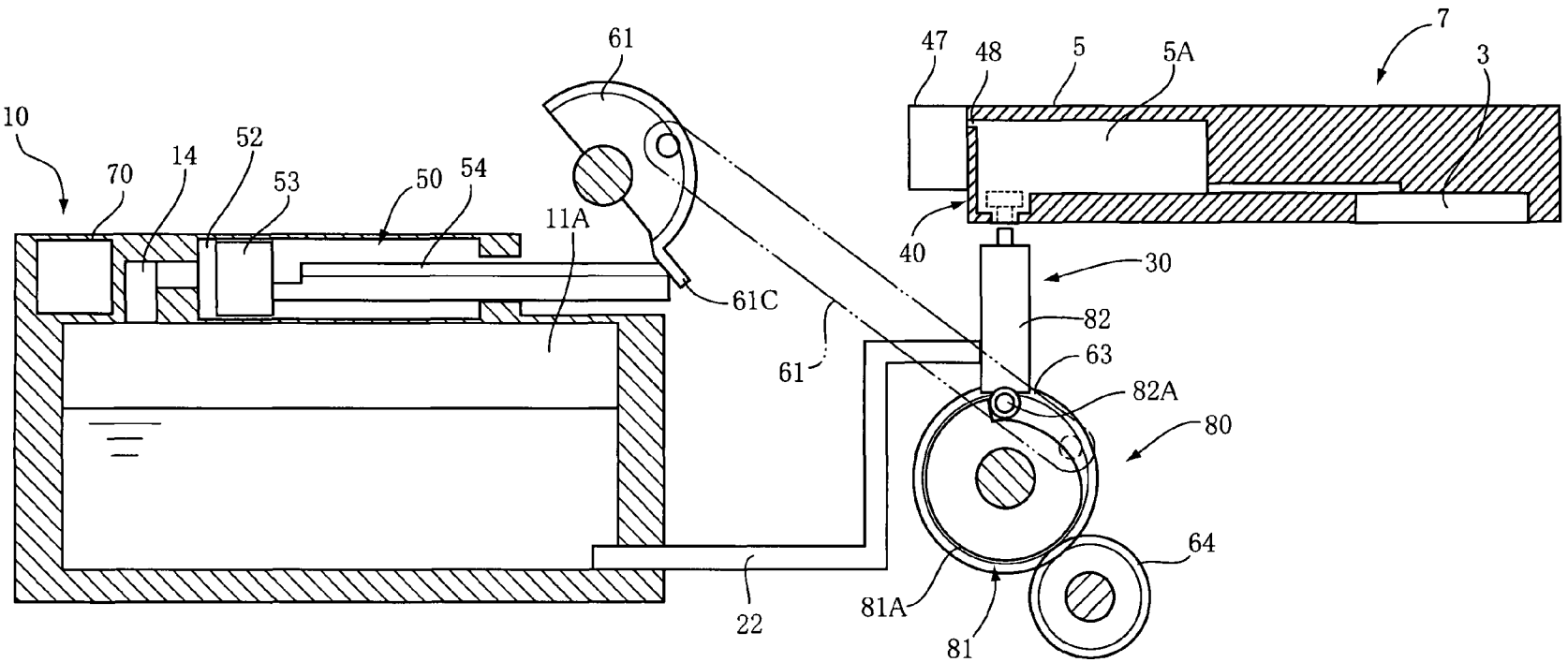
FIG. 9 is an illustrative view showing a state of operation of the main tank unit during an ink supplying operation.

The ink supply device includes (1) a connector which connects the respective sub tanks 5 and the respective ink tanks 11 to each other and (2) a connector operation device 80 which operates the connector to connect the respective sub tanks 5 and the respective ink tanks to each other and disconnect the respective sub tanks 5 and the respective ink tanks 11 from each other. More precisely, the connector includes the main-tank joint valves 30 and the sub-tank joint valves 40. As shown in FIG. 9, the connector operating device 80 operates to move the main-tank joint valves 30 relative to the sub-tank joint valves 40.

A plurality of (in the present embodiment, five) main-tank joint valves 30 and a plurality of (in the present embodiment, five) sub-tank joint valves 40 are provided corresponding to the five sub tanks 5. As described later, the five main-tank joint valves 30 are mechanically synchronized and movable integrally with each other by the connector operating device 80.

Figure 13:
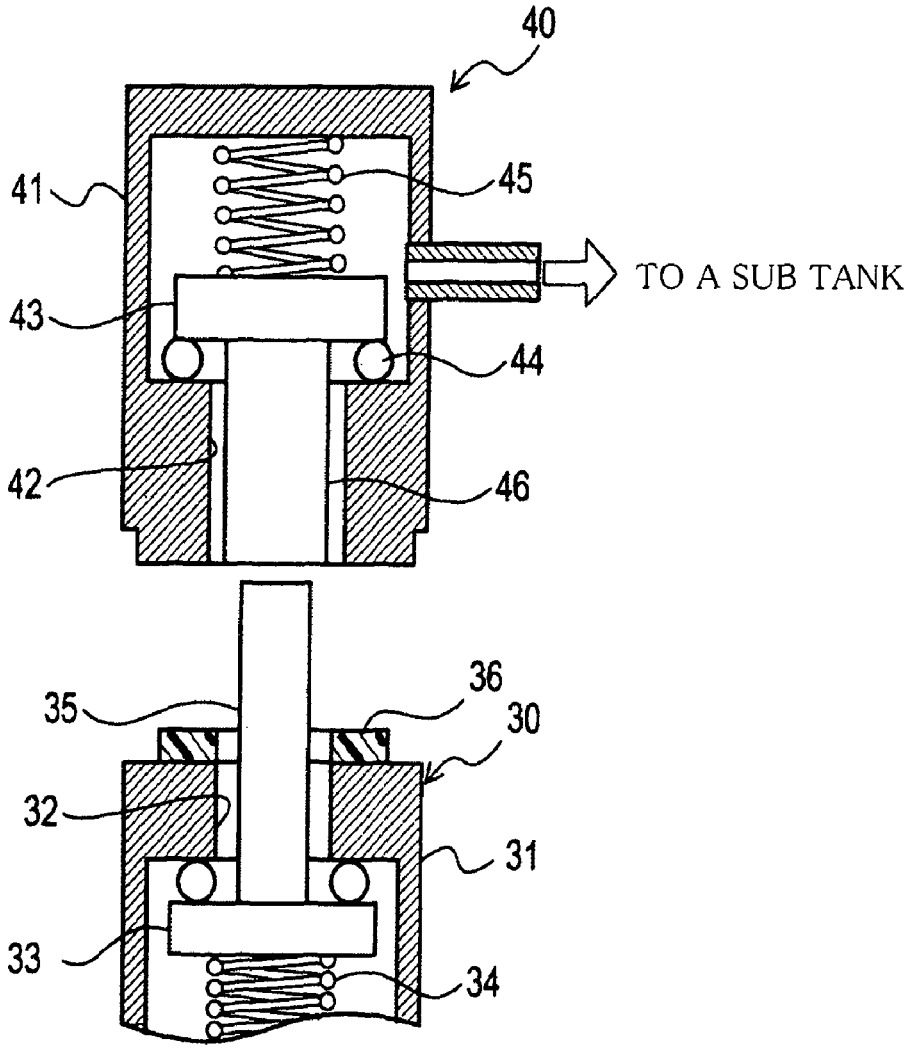
FIG. 13 is an illustrative view showing an operation of a main-tank joint valve and a sub-tank joint valve of the inkjet printer when the ink supplying operation is performed.

Each sub-tank joint valve 40 is fixed to a body of the carriage 7 and communicates with the sub tank 5. As shown in FIG. 13, the sub-tank joint valve 40 includes a cylindrical valve housing 41. In one of opposite end portions of the valve housing 41 close to the main-tank joint valve 30, a valve opening 42 is formed and can be closed by a valve element 43 which is disposed to be movable in the valve housing 41 in a lengthwise direction of the valve housing 41.

In an outer periphery of the valve opening 42, there is provided an O-ring 44 as a sealing device to fluid-tightly close a clearance between the valve element 43 and the outer periphery of the valve opening 42. In the valve housing 41, a coil spring 45 is disposed. The coil spring 45 is an example of an elastic device which presses the valve element 43 in a direction to close the valve opening 42. An initial load and a spring constant of the coil spring 45 are determined such that a sum (F1+F2) of a press force F1 to press the valve element 43 in the direction to close the valve opening 42 owing to a pressure in the valve housing 41, and a press force F2 of the coil spring 45 substantially equals to, or becomes slightly larger than, a press force F3 of the atmospheric pressure to press the valve element 43 in a direction to open the valve opening 43.

In the present embodiment, the sub tank 5, the sub-tank joint valve 40 and the recording head 3 communicate with each other in a lower portion of the sub-tank chamber 5A of the sub tank 5. An upper portion of the sub-tank chamber 5A communicates with an atmosphere communication passage 48 and a pressure control valve 47 is disposed in the atmosphere communication passage 48. The pressure control valve 47 maintains a pressure in the sub tank 5 within a predetermined range around the atmospheric pressure, by means of permitting air to flow out of an inside of the sub tank 5, or an inside of an ink passage, into the atmosphere when the pressure in the sub tank 5 is higher by more than a first predetermined pressure value than the atmospheric pressure and permitting air to flow from the atmosphere into the inside of the sub tank 5 when the pressure in the sub tank 5 is lower by more than a second predetermined pressure value than the atmospheric pressure. The first and the second predetermined pressure values are respectively determined so that a meniscus formed in a nozzle of the recording head 3 is not broken (destroyed). The first and second predetermined pressure values may be the same value.

When ink is supplied to the sub tank 5, the main-tank joint valve 30 and the sub-tank joint valve 40 are connected to each other so that the sub tank 5 and the ink cartridge 10 communicate with each other. As shown in FIG. 9, the respective main-tank joint valves 30 communicate with the respective ink cartridges 10 through respective ink tubes 22 such as pipes or hoses.

As shown in FIG. 13, the main-tank joint valve 30 includes a generally cylindrical valve housing 31, a valve opening 32, a valve element 33, a coil spring 34 and a push rod 35. The valve housing 31 has the valve opening 32 in one of opposite ends of the valve housing 31 close to the sub-tank joint valve 40 in a lengthwise direction thereof. The valve opening 32 can be closed by the valve element 33, which is disposed in the valve housing 31 to be movable in the lengthwise direction of the valve housing 31.

The coil spring 34 is provided in the valve housing 31 and functions as an elastic device which applies a pressure on the valve element 33 in a direction to close the valve opening 32. The push rod 35 is movable integrally with the valve element 33 and protrudes toward the sub-tank joint valve 40 so as to press the push rod 46 of the sub-tank joint valve 30 against the elastic force of the coil spring 45 and open the valve opening 42. In the present embodiment, the push rod 35 is formed integrally with the valve element 33. The valve housing 31 and the valve housing 41 respectively function as joint portions.

Figure 15:
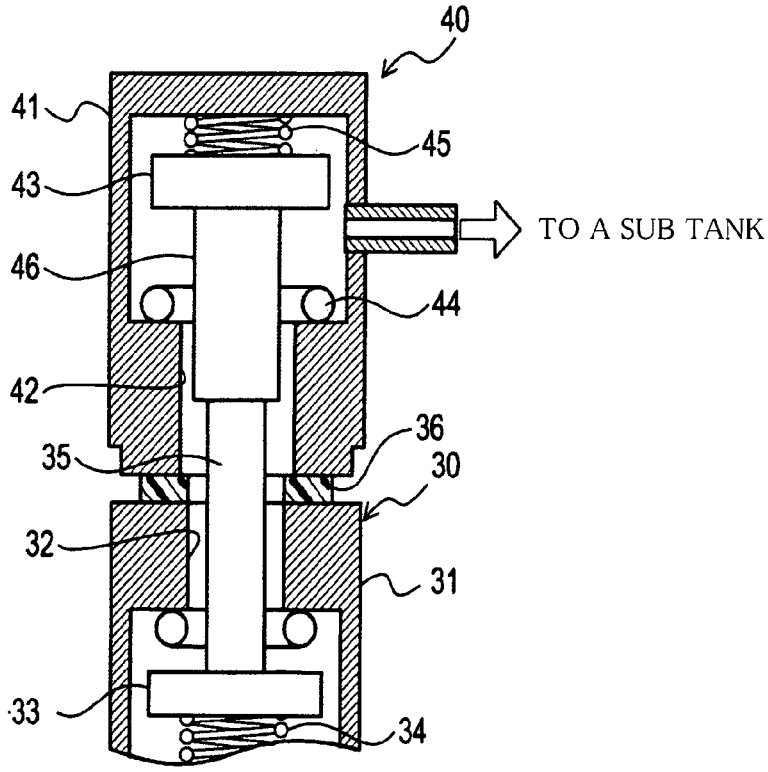
FIG. 15 is an illustrative view showing another operation of the main-tank joint valve and the sub-tank joint valve.

A joint rubber 36 functions as an elastic device being elastically deformable, which fluid-tightly seals the sub-tank joint valve 40 and the main-tank joint valve 30 when the sub-tank joint valve 40 and the main-tank joint valve 30 are connected to each other as shown in FIG. 15, and which reduces an impact and an instantaneous or contact speed when the sub-tank joint valve 40 and the main-tank joint valve 30 are connected to each other (or contacted with each other).

In the present embodiment, the connector operating device 80 functions as a main-tank joint valve operating device which operates the connector such that the main-tank joint valves 30 move relative to the sub-tank joint valves 40 and are connected to or disconnected from the sub-tank joint valves 40.

More precisely, as shown in FIG. 9, the connector operating device 80 includes a cam 81 which is rotated integrally with the first transmission gear 63, a cam follower 82A which is engaged with a cam surface (a profile) 81A formed in an outer circumferential surface of the cam 81, and a push rod 82 which is movable integrally with the cam follower 82A in a lengthwise direction of the push rod 82, according to the cam surface 81A.

Figure 4:
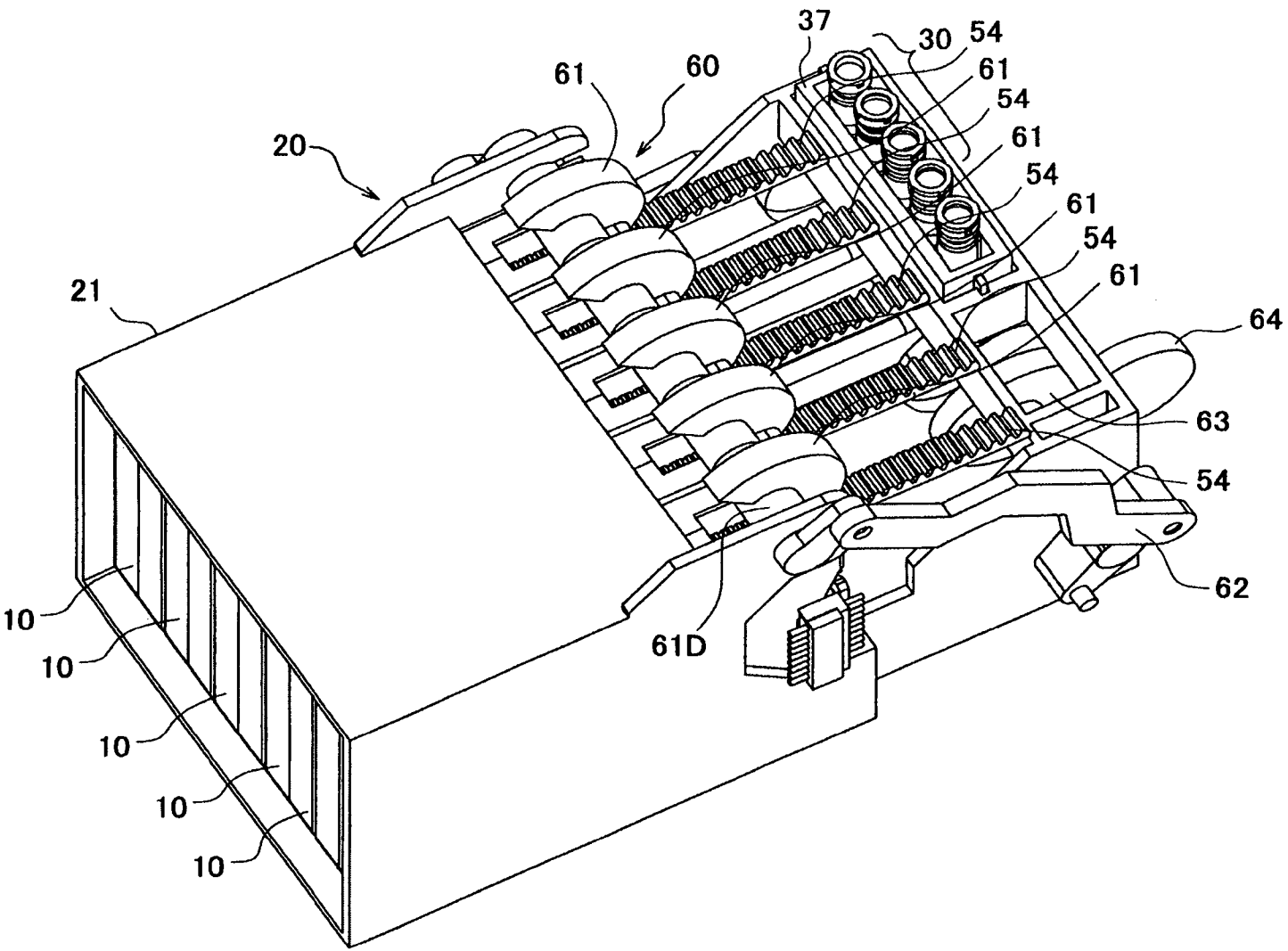
FIG. 4 is a perspective view of the main tank unit.

In the present embodiment, as shown in FIG. 4, the five main-tank joint valves 30 are accommodated in a valve casing 37 and movable integrally with each other in a vertical direction. The push rod 82 of each of the five main-tank joint valves 30 is attached to the valve casing 37 at one of opposite ends (i.e., an upper end in FIG. 9) of the push rod 82 in the lengthwise direction thereof.

Therefore, when the respective first transmission gears 63 and the respective cams 81 are rotated, the respective push rods 82 are moved in the vertical direction or in the lengthwise direction thereof, according to an outline or a profile of the cam surface 81A, so that the five main-tank joint valves 30 are moved integrally with each other in the vertical direction.

Figure 16:
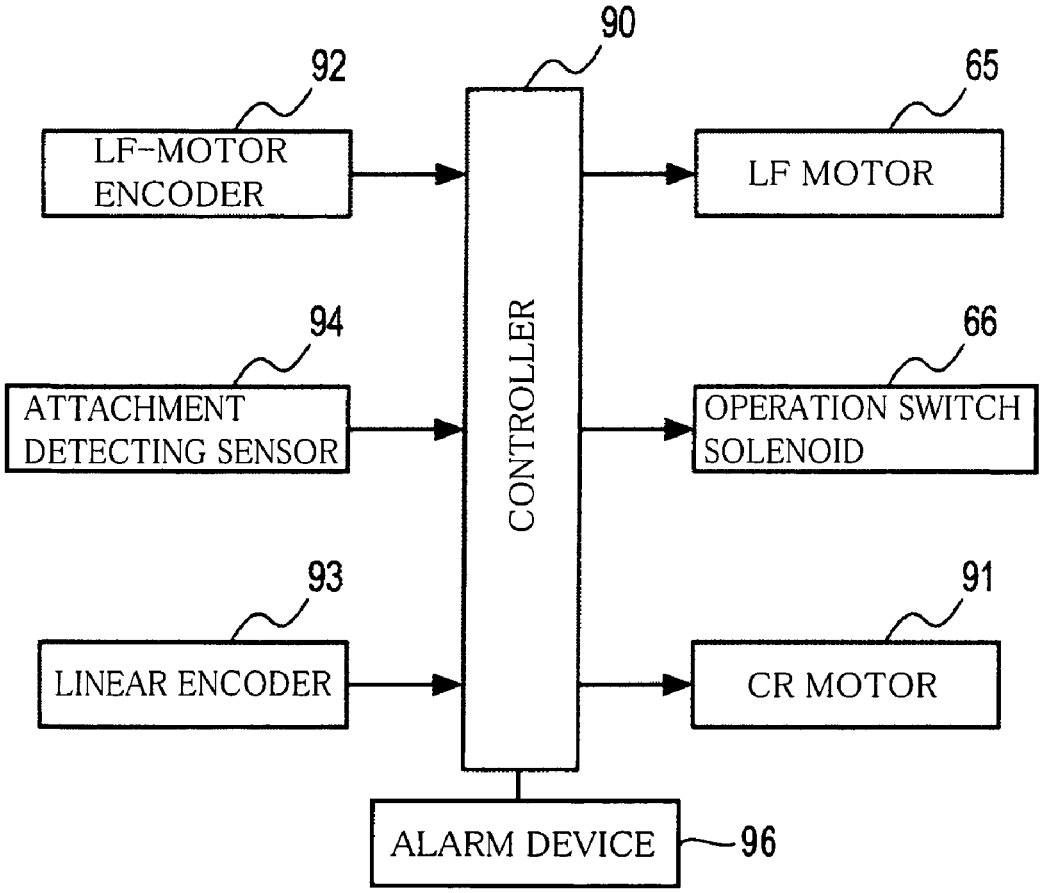
FIG. 16 is a block diagram illustrating an electric system of the printer engine portion.

Referring next to the block diagram of FIG. 16, the printer engine portion 1 includes a controller 90 for controlling various operations of the printer engine portion 1. The controller 90 is constituted by a microcomputer mainly including a CPU (Central Processing Unit), a ROM (Read Only Memory), and a RAM (Random Access Memory). The controller 90 controls operations of the LF motor 65, the operation switch solenoid 66 and a carriage motor (CR motor) 91 which drives the scanning device 9 (the driving pulley 9A).

Various signals are inputted to the controller 90, such as an output signal of an LF-motor encoder 92 which detects a rotation amount (i.e., a rotation angle) of the LF motor 65, an output signal of a linear encoder 93 which detects a rotation amount (a rotation angle) of the CR motor 91 and an attachment detecting sensor 94 such as a limit switch which detects an attachment of each ink cartridge 10 to the cartridge casing 21.

In the present embodiment, the LF motor 65 and the CR motor 91 are constituted by respective stepper motors. Also, the LF motor 65 and the LF-motor encoder 92 are fixed integrally to each other. The controller 90 controls the LF motor 65, the CR motor 91 and the piezoelectric elements of the recording head 3, based on the output signals from the LF-motor encoder 92 and the linear encoder 93, and programs stored in the ROM.

An initializing operation mode is an operation mode to be performed in a state in which the carriage 7 is positioned in the maintenance area, for example, when a new ink cartridge 10 is attached to a frame of the inkjet printer (the cartridge casing 21), or when the piston pumps 50 have been repeatedly started and stopped.

In a case in which the new ink cartridge 10 is attached to the cartridge casing 21, it is highly possible that an actual stop position of the piston 53 when the piston pump 50 is stopped is not aligned with a predetermined (i.e., designed) initial position (i.e., a zero-point position) thereof.

When the actual stop position of the piston 53 is not aligned with the predetermined initial position thereof, an actual movement amount of the piston 53 does not coincide with a predetermined movement amount thereof, causing that a volume of ink supplied to the sub tank 5 is changed and differed from a predetermined volume of ink.

Especially in the present color inkjet printer including the plurality of ink cartridges 10, a plurality of piston pumps 50 are provided corresponding to a plurality of inks having respective colors. In a case in which respective actual stop positions of the respective pistons 53 of the plurality of piston pumps 50 are not aligned with respective predetermined initial positions and are different from each other, respective volumes of inks supplied to the respective sub tanks 5 are differed from each other.

Therefore, in the present embodiment, in the case in which it is highly possible that the actual stop position of the piston 53 is not aligned with the predetermined initial position thereof, the controller 90 controls to perform the initializing operation in which the LF motor 65 is driven and rotated in a direction in which the rod-moving portion 61C contacts a rear end (i.e., the one end distant from the piston 53) of the piston rod 54, until the rotation of the LF motor 65 is forcedly stopped. Thus, the pinion 61 is rotated by the LF motor 65, with the result that the piston rod 54 and the piston 53 are advanced in the lengthwise direction thereof by the rod-moving portion 61C and then the LF motor 65 is inhibited from further rotation and stopped when the piston rod 54 and the piston 53 reach advancing limits thereof. The stopping of the LF motor 65 is detected by the LF-motor encoder 92 and, based on the detection by the LF-motor encoder 92, the controller 90 stops an output of an operation command to the LF motor 65.

As mentioned before, the plurality of pinions 61 are mechanically synchronized and rotated by the same rotation amount, so that, after the initializing operation is performed, the respective pistons 53 of the respective ink cartridges 10 are positioned at the same position in the lengthwise direction of the piston rods 54.

The initializing operation is performed in a case in which the new ink cartridge 10 is attached to the cartridge casing 21, the ink cartridge 10 is attached again to the cartridge casing 21, the piston pumps 50 have been repeatedly started and stopped, or ink is supplied to the sub tank 5.

In the present embodiment, when the initializing operation is performed, the pistons 53 are moved to the predetermined initial positions at which the atmosphere communication valve 70 is opened and the atmosphere communication passage 15 is opened. Thus, when the initializing operation is performed, the respective ink tanks 11 communicate with the atmosphere and pressures in the respective ink-tank chambers 11A become equal to the atmospheric pressure.

Figure 17:
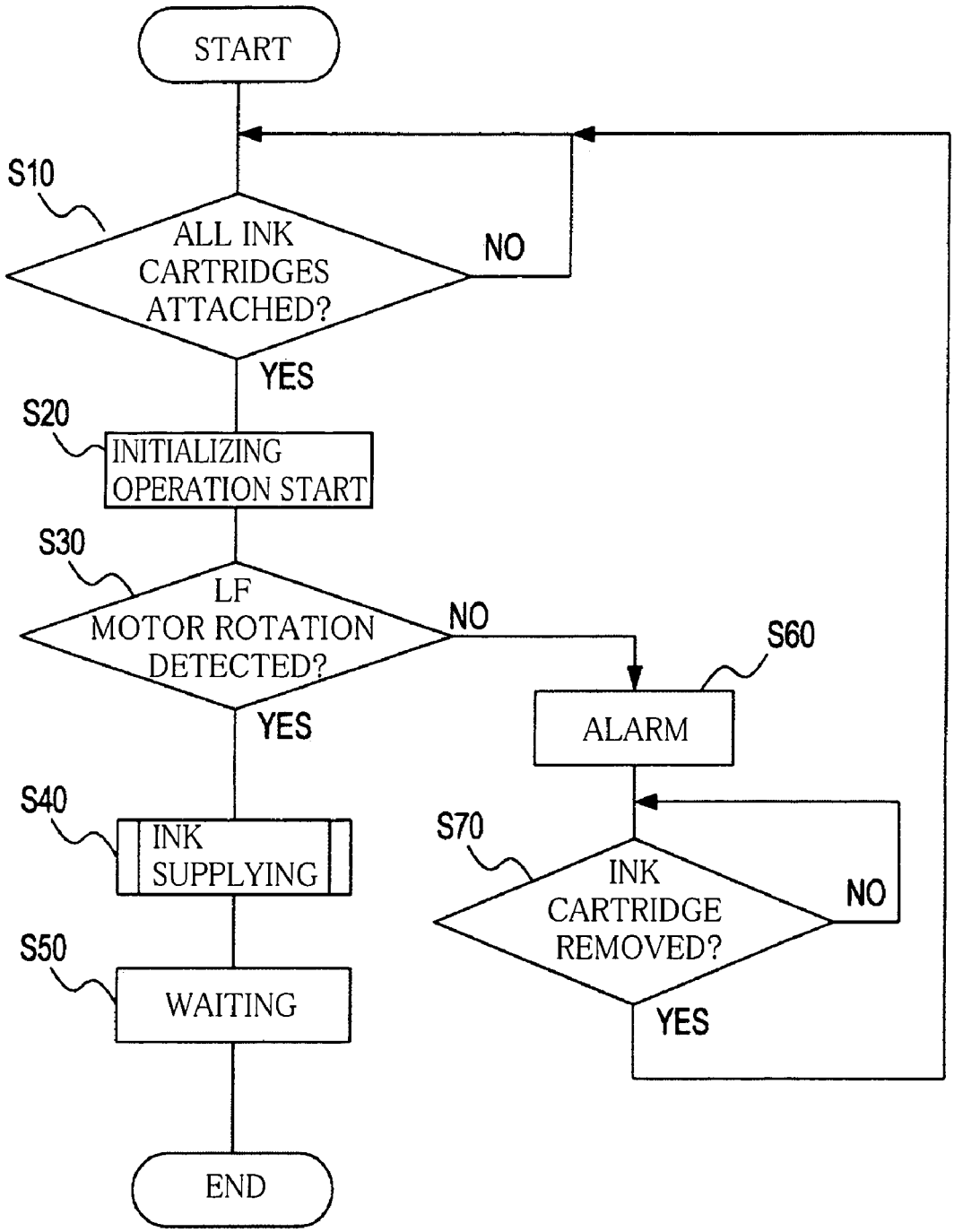
FIG. 17 is a flow chart illustrating an initializing operation routine implemented by a controller of the ink-jet printer in a case in which the ink cartridge is attached again to a cartridge casing.

Reference is now made to the flow chart in FIG. 17 illustrating one embodiment of the initializing operation routine. The flow chart in FIG. 17 illustrates the initializing operation routine performed in the case in which the ink cartridge 10 is attached again to the cartridge casing 21.

The initializing operation routine is started simultaneously when a power source of the inkjet printer is turned on. First, in step S10, it is determined whether all the ink cartridges 10 are normally attached to the cartridge casing 21, based on output signals from the attachment-detecting sensors 94.

That the ink cartridge 10 is normally attached to the cartridge casing 21 means that the ink cartridge 10 is attached to an attachment position in the cartridge casing 21 where ink can be normally supplied and received between the ink cartridge 10 and the main-tank joint valve 30. In the present embodiment, when the ink cartridge 10 has normally been attached to the cartridge casing 21, an ON signal is outputted from the attachment-detecting sensor 94.

In a case in which it is determined that all the ink cartridges 10 are normally attached to the cartridge casing 21, i.e., an affirmative decision (Yes) is obtained in step S10, the operation switch solenoid 66 is operated such that the drive force of the LF motor 65 is transmissible to the second transmission gear 64, and the controller 90 transmits an initializing operation command to the LF motor 65 to rotate the LF motor 65 by a predetermined rotation amount. Thus, the above-mentioned initializing operation is started (step S20). In a case in which it is determined that at least one of the ink cartridges 10 is not normally attached to the cartridge casing 21, i.e., a negative decision (No) is obtained in step S10, the initializing operation is not started.

After the controller 90 transmits the initializing operation command to the LF motor 65, in step S30, it is determined whether the LF motor 65 is actually rotated by the predetermined rotation amount, based on the output signal from the LF-motor encoder 92. In a case in which it is detected that the LF motor 65 is actually rotated by the predetermined rotation amount, i.e., an affirmative decision (Yes) is obtained in step S30, an ink-supplying operation, which is mentioned later, is performed in step S40, and then, in step S50, the carriage 7 is kept in a waiting state in the maintenance area until a printing command is provided.

On the other hand, in a case in which it is detected that the LF motor 65 is not rotated by the predetermined rotation amount, i.e., a negative decision (No) is obtained in step S30, step S60 is carried out so that an alarm is produced to a user of the inkjet printer through an alarm device 96 (shown in FIG. 16) including at least one of an alarm lamp, an alarm buzzer and a display. The alarm means that "the initializing operation is not normally performed, and all the ink cartridges 10 should be attached again." Then, in step S70, it is determined whether all the ink cartridges 10 have been removed from the cartridge casing 21, based on the output signals from the attachment detecting sensors 94.

The alarm device 96 keeps producing the alarm until all the ink cartridges 10 are removed from the cartridge casing 21. In a case in which all the ink cartridges have been removed and an affirmative decision (Yes) is obtained in step S70, the initializing operation routine is returned to step S10, and it is determined whether all of the ink cartridges 10 are normally attached to the cartridge casing 21.

In the present embodiment, when a volume of ink stored in the sub tank 5 becomes lower than a predetermined volume of ink or when the initializing operation is completed, the ink-supplying operation is performed in a state in which the carriage 7 is positioned in the maintenance area.

In the present embodiment, when a number of times of ink ejection from the recording head 3 (including a number of times of ink ejection in a purging operation), which has been calculated since ink was last supplied to the sub tank 5, has reached a predetermined number of times, it is presumed that the volume of ink stored in the sub tank 5 is lower than the predetermined volume of ink.

Figure 10:
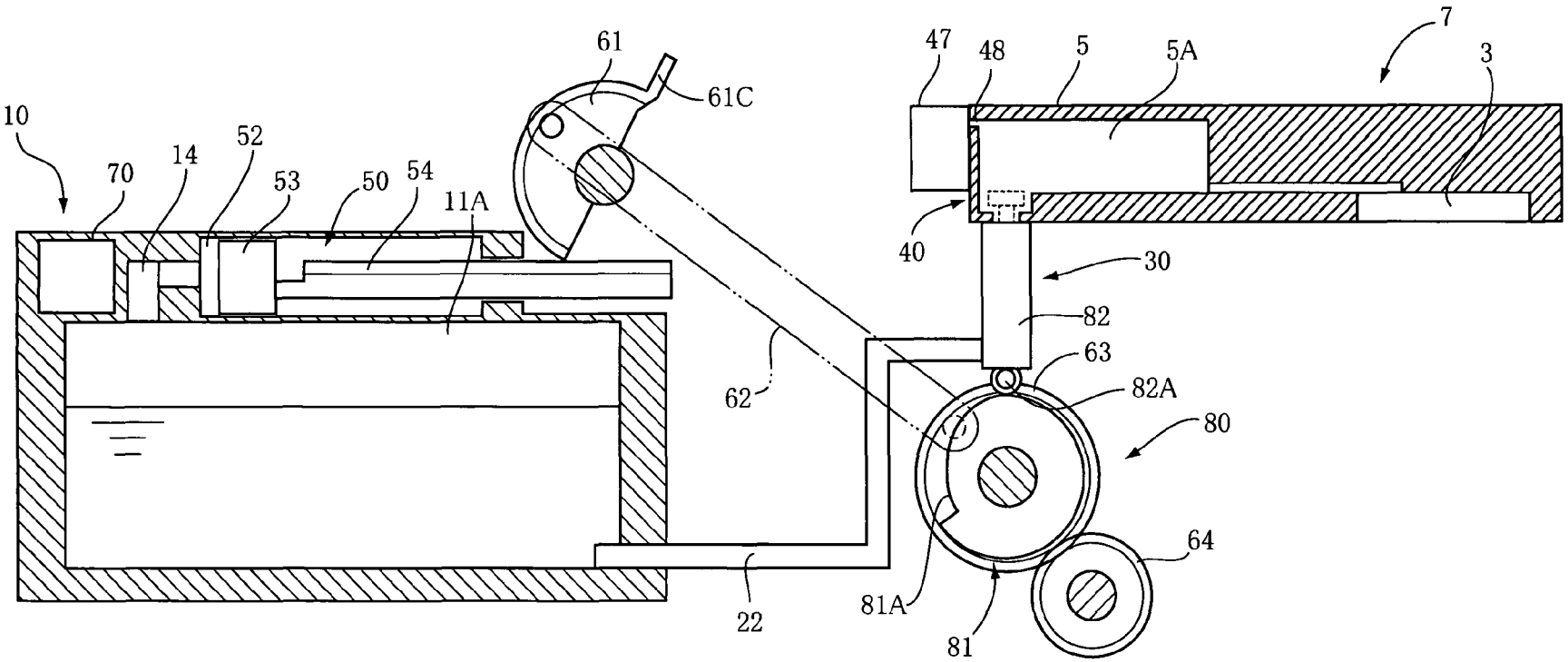
FIG. 10 is an illustrative view showing another state of operation of the main tank unit.

When it is determined by the controller 90 that the volume of ink stored in the sub tank 5 is lower than the predetermined volume of ink or the initializing operation is completed, as shown in FIG. 10, the cam 81 is further rotated to move the main-tank joint valves 30 upward relative to the main-tank joint valves 40 in a state in which the pistons 53 are positioned in the predetermined initial positions in which the volumes of the pressure chambers 52 have been decreased and the atmosphere communication valves 70 have been opened so that the pressures in the ink-tank chambers 11A become equal to the atmospheric pressure, as shown in FIG. 9.

Figure 14:
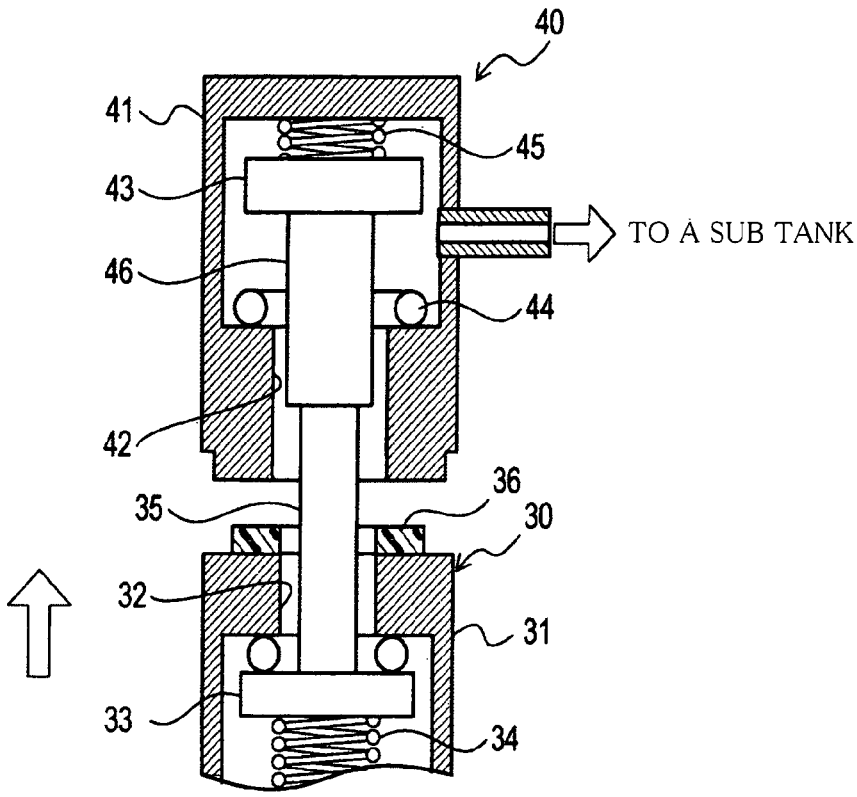
FIG. 14 is an illustrative view showing another operation of the main-tank joint valve and the sub-tank joint valve.

As shown in FIG. 13, the main-tank joint valve 30 and the sub-tank joint valve 40 are closed in the state in which the joint valves 30, 40 are disconnected from each other. As the main-tank joint valve 30 moves toward the sub-tank joint valve 40, as shown in FIG. 14, the joint valves 30, 40 are opened. Finally, as shown in FIG. 15, the main-tank joint valve 30 and the sub-tank joint valve 40 fluid-tightly communicate with each other in the state in which the joint valves 30, 40 are connected to each other.

At that time, the controller 90 controls a rotation speed of the LF motor 65 such that a contact speed (velocity) V1 constituting an instantaneous rate when the main-tank joint valve 30 contacts the sub-tank joint valve 40 is made smaller than a speed (velocity) V2 when the main-tank joint valve 30 moves upward toward the sub-tank joint valve 40. The rotation speed of the LF motor 65 corresponding to the contact speed V1 is smaller than the rotation speed of the LF motor 65 for moving the piston 53 of the piston pump 50.

As mentioned above, the plurality of pinions 61 are mechanically synchronized and rotated by the same rotation amount. Also, the plurality of main-tank joint valves 30 move up and down integrally with each other. Therefore, the respective pistons 53 and the respective main-tank joint valves 30 operate in the same manner as mentioned above.

Figure 11:
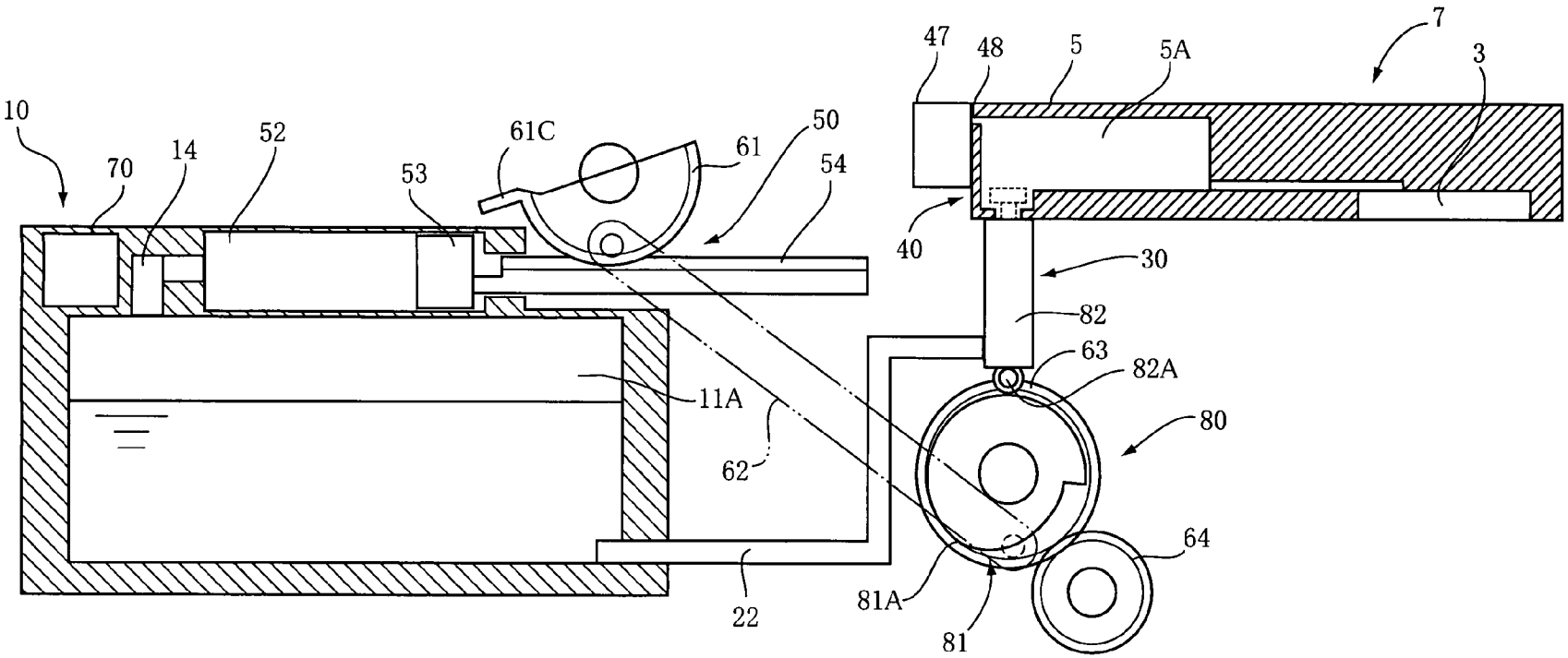
FIG. 11 is an illustrative view showing another state of operation of the main tank unit.

After the main-tank joint valve 30 and the sub-tank joint valve 40 are connected to each other, as shown in FIG. 11, the controller 90 moves the piston 53 backward to increase the volume of the pressure chamber 52 in the state in which the joint valves 30, 40 are connected to each other. As a result, substantial whole volumes of inks stored in the respective sub-tank chambers 5A are returned to the respective ink-tank chambers 11A (i.e., the respective ink cartridges 10).

Next, under the control of the controller 90, in the state in which the joint valves 30, 40 are connected to each other, the pistons 53 are moved forward to respective advanced positions without opening the atmosphere communication valves 70 (i.e., positions slightly backward from the predetermined initial positions of the pistons 53 shown in FIG. 10) to decrease the volumes of the pressure chambers 52, so that the inks stored in the ink-tank chambers 11A (i.e., the ink cartridges 10) are supplied to the respective sub-tank chambers 5A. The pressure control valves 47 prevent the pressures supplied to the respective sub-tank chambers 5A from becoming higher than a pressure breaking the meniscus formed in each nozzle of the recording head 3. Thus, the inks can be supplied to the respective sub-tank chambers 5A from the respective ink-tank chambers 11A without breaking the menisci.

After the ink-supplying operation including at least one full reciprocating movement of the piston 53 is completed, the controller 90 moves the main-tank joint valves 30 downward to disconnect the main-tank joint valves 30 and the sub-tank joint valves 40 from each other, in a state in which the pistons 53 are not moved and are kept at the respective advanced positions to decrease the volumes of the pressure chambers 52. The joint valves 30, 40 are operated in an order shown in FIG. 15, FIG. 14 and FIG. 13, contrary to an order when the joint valves 30, 40 are connected to each other.

During recording of an image on a recording sheet, the sub-tank joint valves 40 and the main-tank joint valves 30 are disconnected from each other and the joint valves 30, 40 are closed. In this state, as the inks stored in the respective sub tanks 5 are consumed, the pressures in the sub tanks 5 are lowered. However, the pressure control valves 47 prevent the pressures in the sub tanks 5 from being lowered by more than the second predetermined pressure value than the atmospheric pressure, so that the menisci formed in the recording head 3 are not broken by lowered pressures (i.e., negative pressures) in the sub tanks 5.

In the present embodiment, the ink is supplied to the sub tank 5 by means of a pressure in the ink tank 11 being made higher than that in the sub tank 5 when the piston 53 is moved to decrease the volume of the pressure chamber 52. Thus, the pressure in the sub tank 5 cannot be lower than the atmospheric pressure, contrary to a case in which ink is sucked into the sub tank 5.

Therefore, even if the meniscus formed in the nozzle of the recording head 3 may be broken, air can be prevented from flowing into an inside of the recording head 3 through the nozzle so that a volume of ink supplied to the sub tank 5 may be decreased by the flowing air. Thus, an adequate volume of ink can be supplied to the sub tank 5.

Also, in the present embodiment, since at least a portion of each piston rod 54 is covered by the pair of rod covers 13, a user is inhibited from contacting the piston rod 54 when the user attaches the ink cartridge 10 to the cartridge casing 21 and detaches the ink cartridge 10 from the same 21, and problems such as breaking of the piston rod 54 are preferably prevented.

The pair of rod covers 13 cover the full range of the piston rod 54 in the lengthwise direction thereof, when the volume of the pressure chamber 52 is smaller than the largest volume of the pressure chamber 52, in the present embodiment, when the volume of the pressure chamber 52 is the smallest volume. Therefore, the user is reliably prevented from contacting the piston rod 54 by accident during attaching and detaching of each ink cartridge 10.

Further, in the present embodiment, when it is highly possible that the actual stop position of the piston 53 when the piston pump 50 is stopped is not aligned with the predetermined initial position thereof, the initializing operation is performed. Therefore, the actual stop position of the piston 53 is aligned with the predetermined initial position thereof, so that the volume of ink supplied to the sub tank 5 is prevented from being changed.

Especially, in the present color inkjet printer, the respective volumes of inks supplied to the respective sub tanks 5 are free from differing from each other.

Furthermore, in the present embodiment, the initializing operation is performed when the ink is supplied from the ink cartridge 10 to the sub tank 5, so that the volume of ink supplied to the sub tank 5 is reliably prevented from being changed.

In the present embodiment, since the atmosphere communication passage 15 is opened when the initializing operation is performed and is closed except the duration of the initializing operation, the pressure in the ink tank 11 can be equal to the atmospheric pressure and the stop position of the piston 53 can be aligned with the predetermined initial position.

Therefore, the constant volume of ink proportional to a constant amount of operation of the piston pump 50 can be supplied from the ink cartridge 10 to the sub tank 5, preventing the following problems: (A) that a larger volume of ink than necessary is supplied to the sub tank 5; (B) that an insufficient volume of ink is supplied to the sub tank 5; and (C) that ink leaks through the pressure control valve 47 or the connecting portion connecting the ink cartridge 10 and the sub tank 5 to each other.

In the present embodiment, it is presumed that the initializing operation is not normally performed when it is detected that the LF motor 65 is not rotated by the predetermined rotation amount and the alarm is produced to the user. Thus, the image recording operation is prevented from being performed without performing the initializing operation of the piston 53.

Generally, no shut-off valve is provided in the nozzle of the recording head 3, and a dome-like meniscus formed by a surface tension of ink existing in the nozzle prevents the ink from leaking from the nozzle when the carriage 7 is in the waiting state.

Therefore, if the instantaneous speed (contact or move-away speed) V1 when the main-tank joint valve 30 and the sub-tank joint valve 40 are connected to each other and are disconnected from each other is made higher, the meniscus may possibly be broken by an extreme fluctuation in pressure or an impact force acts on the recording head 3 when the joint valves 30, 40 are connected to each other or are disconnected from each other.

However, in the present embodiment, the drive source (i.e., the LF motor 65) for moving the piston 53 is commonly used for the connection and disconnection of the joint valves 30, 40. In other words, the connector operating device 80 shares the drive source with the piston pump 50. Thus, when the contact or move-away speed V1 is made lower, a movement speed of the piston 53 is made lower, with the result that a time period required for supplying ink becomes longer.

Accordingly, in the present embodiment, the rotation speed of the LF motor 65 is determined such that the contact or move-away speed V1 constituting the instantaneous rate when the main-tank joint valve 30 and the sub-tank joint valve 40 are connected to each other or are disconnected from each other is made lower than the speed V2 of movement of the main-tank joint valve 30 relative to the sub-tank joint valve 40 in the state in which the main-tank joint valve 30 and the sub-tank joint valve 40 are separate from each other. Therefore, the meniscus is prevented from being broken by the extreme fluctuation in pressure or the impact force acting on the recording head 3, and the time period required for supplying ink can be reduced.

Further, in the present embodiment, the movement speed V2 is higher than the contact or move-away speed V1, so that the meniscus is prevented from being broken by the extreme fluctuation in pressure and the impact force acting on the recording head 3, and the operating time for the connection and disconnection of the joint valves 30, 40 can be reduced.

In the present embodiment, a power transmission device is constituted by the pump drive device 60 including the pinion 61, the connecting rod 62, the first transmission gear 63 and the second transmission gear 64. Also, a piston-position initializing device includes the LF motor 65, the power transmission device, the rod-moving portion 61C and a portion of the controller 90 that implements step S20 of the initializing operation routine. An operation detecting device includes the LF-motor encoder 92 and a portion of the controller 90 that implements step S30. An alarm device includes the alarm device 96 and a portion of the controller 90 that implements step S60. A drive source controller is constituted by portion of the controller 90 that implements step S20 and step S40, respectively.

In the illustrated embodiment, each of the pair of rod covers 13 has an L-shaped structure as seen in the lengthwise direction of the piston rod 54. In modified embodiments shown in FIGS. 18A through 18D, each of the pair of rod covers 13 has a different shape from that employed in the illustrated, first embodiment.

In the modified embodiments, the pair of rod covers 13 cover at least a portion of the piston rod 54 in the lengthwise direction thereof. In the modified embodiment shown in FIG. 18A, each rod cover 13 is free of the rack cover portion 13B employed in the illustrated embodiment and has a generally I-shaped structure in its cross section as seen in the lengthwise direction of the piston rod 54. Also, in the modified embodiment shown in FIG. 18B, each rod cover 13 has a generally I-shaped structure in its cross section and a portion corresponding to the side cover portion 13A employed in the illustrated embodiment is made smaller in height than the side cover portion 13A.

Figure 18A:
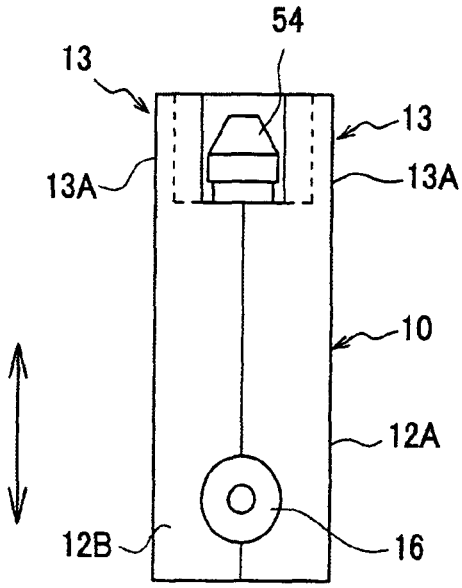
FIGS. 18A through 18D are views showing respective structures of respective ink cartridges of inkjet printers as modified embodiments to which the present invention is applied.
Figure 18B:
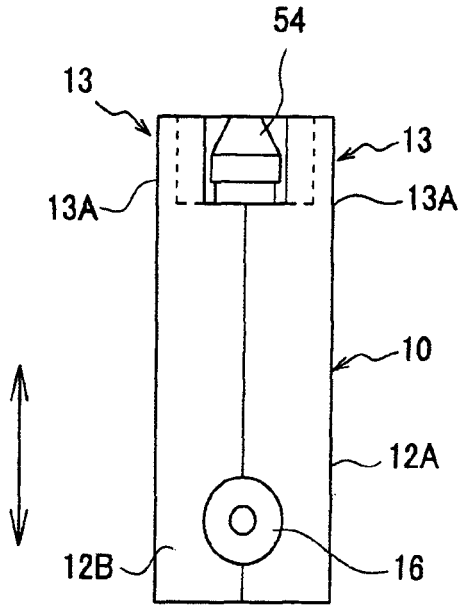
Figure 18C:
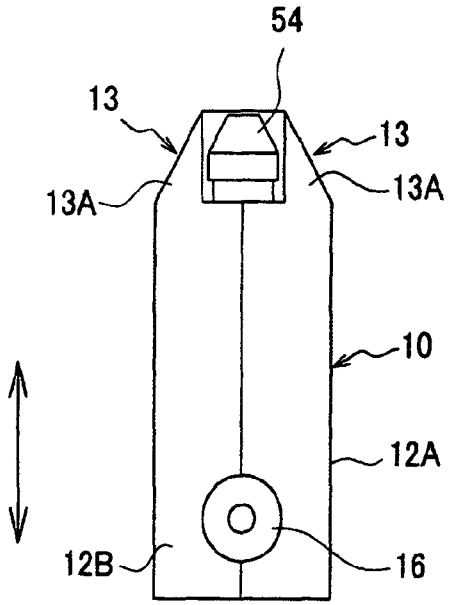
Figure 18D:
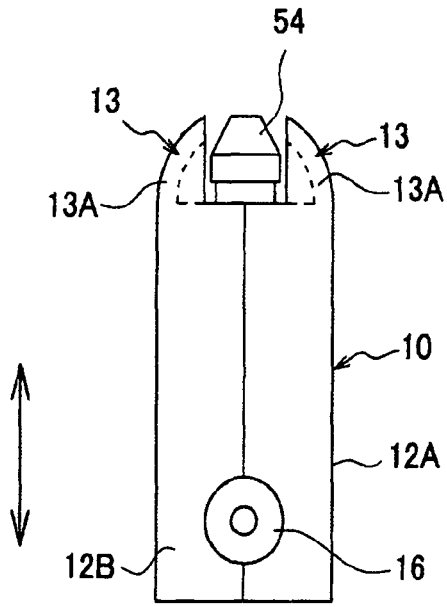

Further, in the modified embodiment shown in FIG. 18C, each rod cover 13 has a side cover portion 13A which is level with the side cover portion 13A shown in FIG. 18B and is free of the rack cover portion 13B, and which has a generally triangular shape as seen in the lengthwise direction of the piston rod 54. In the modified embodiment shown in FIG. 18D, each rod cover 13 is free of the rack cover portion 13B and has a side cover portion 13A which is level with the side cover portion 13A shown in FIG. 18B, and which has a generally circular arc shape as seen in the lengthwise direction of the piston rod 54.

In the ink cartridge 10 employed in the illustrated embodiment, the rod covers 13 cover the portion of the piston rod 54 in which the rack 54A and the pinion 61 are engaged with each other. However, the present invention is not limited to this feature.

Also, in the ink cartridge 10 employed in the illustrated embodiment, the pair of rod covers 13 cover the whole (full range) of the piston rod 54 in the lengthwise direction thereof when the volume of the pressure chamber 52 is most decreased. However, the present invention is not limited to the illustrated embodiment. For example, the pair of rod covers 13 may cover the full range of the piston rod 54 in the lengthwise direction thereof in a state in which the volume of the pressure chamber 52 is larger than that when the volume of the pressure chamber 52 is most decreased, and in a state in which the volume of the pressure chamber 52 is smaller than that when the volume of the pressure chamber 52 is most increased.

Further, in the illustrated embodiment, the ink tank 11 communicates with the atmosphere when the initializing operation is performed. The present invention is not limited to this feature. For example, when the main-tank joint valve 30 and the sub-tank joint valve 40 are connected to each other, a state in which the joint valves 30, 40 are opened and prior to the state in which the joint valves 30, 40 are fluid-tightly connected to each other, may be kept for a predetermined time period so that the ink tank 11 communicates with the atmosphere.

Furthermore, the present invention is not limited to the illustrated embodiment in which the initializing operation is performed before the ink is supplied to the sub tank 5. The present invention is not limited to the illustrated embodiment in which, when it is detected that the LF motor 65 is not rotated by the predetermined rotation amount during the initializing operation, the alarm that the initializing operation is not normally operated is produced to the user.

In the illustrated embodiment, the contact or move-away speed V1 when the main-tank joint valve 30 and the sub-tank joint valve 40 are connected to each other or are disconnected from each other is made lower than the speed V2 of movement of the main-tank joint valve 30 relative to the sub-tank joint valve 40 in the state in which the main-tank joint valve 30 and the sub-tank joint valve 40 are separate from each other. However, the present invention is not limited to this feature.

The present invention is not limited to the illustrated embodiment in which the rotation speed of the LF motor 65 corresponding to the contact or move-away speed V1 is made lower than a rotation speed thereof corresponding to an operation speed V3 of the piston pump 50 when the piston pump 50 is in operation.

In the illustrated embodiment, the speeds V1, V2 are controlled by means of controlling the rotation speed of the LF motor 65. However, the present invention is not limited to this feature. For example, the rotation speed of the LF motor 65 is fixed, and the cam 81 is provided with the cam surface (profile) 81A that defines the following relationship between the speeds V1, V2, V3: V1<V2, and V1<V3.

The present invention is not limited to the illustrated embodiment in which the main-tank joint valve 30 moves up and down relative to the sub-tank joint valve 40. For example, the sub-tank joint valve 40 may move relative to the main-tank joint valve 30, or the main-tank joint valve 30 may move in a horizontal direction relative to the sub-tank joint valve 40, or vice versa.

The present invention is not limited to the illustrated embodiment in which the pinion 61 has a semicircular shape including the first area 61A and the second area 61B. Further, the present invention is not limited to the illustrated embodiment in which the initializing operation is performed by means of pushing the one end of the piston rod 54 in the lengthwise direction thereof by the rod-moving portion 61C.

It is to be understood that the present invention may be embodied with various changes and improvements that may occur to a person skilled in the art, without departing from the spirit and scope of the invention defined in the appended claims.

What is claimed is:

1. An inkjet printer of a station-supply type in which, when ink is supplied from a main tank of an ink cartridge to a sub tank storing ink to be supplied to a recording head, the ink cartridge and the sub tank are connected to each other, the inkjet printer comprising:

a piston pump including (a) a cylinder which communicates with the main tank and (b) a piston which is slidable in the cylinder in a lengthwise direction thereof and cooperates with the cylinder to form a pressure chamber;

a power transmission device which transmits a power to the piston in a state in which the ink cartridge is attached to a frame of the inkjet printer; and a piston-position initializing device which moves the piston to a predetermined initial position;

wherein the piston pump further includes a piston rod which is movable integrally with the piston;

wherein the power transmission device transmits the power to the piston rod in the state in which the ink cartridge is attached to the frame;

wherein the power transmission device includes a pinion which is engageable with a rack provided in the piston rod;

wherein the piston-position initializing device includes a rod-moving portion which is provided in the pinion and is operable to move the piston rod;

wherein the pinion includes, on an outer circumference thereof, (I) a first area which has a toothed portion which is engageable with the rack and constitutes the rod-moving portion, and (II) a second area free of the toothed portion; and wherein the power transmission device is arranged such that the second area of the pinion is opposed to the rack when the piston-position initializing device is in operation.

2. The inkjet printer according to claim 1;

wherein the piston-position initializing device operates when the ink is supplied from the ink cartridge to the sub tank.

3. The inkjet printer according to claim 1, further comprising:

an atmosphere communication valve which is operable to open an atmosphere communication passage so that the main tank communicates with an atmosphere, and to shut the atmosphere communication passage;

wherein the atmosphere communication valve opens the atmosphere communication passage when the piston-position initializing device is in operation, and shuts the atmosphere communication passage when the piston-position initializing device is not in operation.

4. The inkjet printer according to claim 1, further comprising:

a pressure control valve which is provided in an atmosphere communication passage communicating with an upper portion of the sub tank and which maintains a pressure in the sub tank, within a predetermined range around an atmospheric pressure, by means of permitting air to flow out of an inside of the sub tank into an atmosphere when the pressure in the sub tank is higher by more than a first predetermined pressure value than the atmospheric pressure and permitting air to flow from the atmosphere into the inside of the sub tank when the pressure in the sub tank is lower by more than a second predetermined pressure value than the atmospheric pressure.

5. The inkjet printer according to claim 1, further comprising:

a plurality of the ink cartridges corresponding to a plurality of inks having respective colors.

6. The inkjet printer according to claim 1;

wherein respective operations of the power transmission device and the piston-position initializing device are linked to each other.

7. The inkjet printer according to claim 6, further comprising:

an operation detecting device which detects the operation of the power transmission device; and an alarm device which produces an alarm to an outside of the inkjet printer when the operation of the power transmission device is not detected by the operation detecting device in a state in which the piston-position initializing device is in operation.

8. The inkjet printer according to claim 1, further comprising:

a connector which connects the sub tank and the main tank to each other; and a connector operating device which operates the connector to connect the sub tank and the main tank to each other and disconnect the sub tank and the main tank from each other;

wherein the connector operating device shares a drive source with the piston pump; and wherein the connector operating device operates the connector in a state in which the second area of the pinion is opposed to the rack.

9. The inkjet printer according to claim 8;

wherein the connector includes a sub-tank joint valve and a main-tank joint valve which are connected to the sub tank and the main tank, respectively, and which includes respective joint portions and respective shut-off valves which open when the respective joint portions are connected to each other, and close when the joint portions are disconnected from each other; and wherein the connector operating device includes a cam which is rotated with the pinion by the drive source, and a cam follower which is engaged with the cam to move the main-tank joint valve relatively to the sub-tank joint valve.

10. The inkjet printer according to claim 1, further comprising:

a connector which connects the sub tank and the main tank to each other; and a connector operating device which operates the connector to connect the sub tank and the main tank to each other and disconnect the sub tank and the main tank from each other;

wherein respective operations of the connector operating device and the piston pump are linked to each other.

11. The inkjet printer according to claim 10;

wherein the connector operating device shares a drive source with the piston pump.

12. The inkjet printer according to claim 1, further comprising:

a connector which connects the sub tank and the main tank to each other; and a connector operating device which operates the connector to connect the sub tank and the main tank to each other and disconnect the sub tank and the main tank from each other;

wherein an operation of the connector operating device is linked to respective operations of the piston pump and the piston-position initializing device.

13. The inkjet printer according to claim 12, further comprising:

a drive source common to the piston pump, the piston-position initializing device and the connector operating device.

14. An inkjet printer of a station-supply type in which, when ink is supplied from a main tank of an ink cartridge to a sub tank storing ink to be supplied to a recording head, the ink cartridge and the sub tank are connected to each other, the inkjet printer comprising:

a piston pump including (a) a cylinder which communicates with the main tank and (b) a piston which is slidable in the cylinder in a lengthwise direction thereof and cooperates with the cylinder to form a pressure chamber;

a power transmission device which transmits a power to the piston in a state in which the ink cartridge is attached to a frame of the inkjet printer;

a piston-position initializing device which moves the piston to a predetermined initial position;

a connector which connects the sub tank and the main tank to each other; and a connector operating device which operates the connector to connect the sub tank and the main tank to each other and disconnect the sub tank and the main tank from each other;

wherein an operation of the connector operating device is linked to respective operations of the piston pump and the piston-position initializing device; and wherein the inkjet printer further comprises:

a drive source common to the piston pump, the piston-position initializing device, and the connector operating device; and a drive-source controller which controls the drive source to operate the piston-position initializing device in a state in which the connector disconnects the sub tank and the main tank from each other and cause at least one full reciprocating movement of the piston in a state in which the connector connects the sub tank and the main tank to each other.

* * * * *